US005761589A

United States Patent [19]

Kido et al.

[11] Patent Number: 5,761,589

[45] Date of Patent: Jun. 2, 1998

[54] DETACHABLE DEVELOPING DEVICE FOR PROVIDING FIRST AND SECOND VOLTAGES FOR AN IMAGE FORMING APPARATUS

[75] Inventors: Eiichi Kido, Yamatokoriyama; Toshihiro Ota, Nara; Shigeyuki Wakada, Yamatokoriyama; Yuhi Yui, Nabari; Tokio Awata, Ikoma; Satoshi Murakami, Yamatokoriyama, all of Japan

[73] Assignee: Sharp Kabushiki Kaisha, Osaka, Japan

[21] Appl. No.: 610,549

[22] Filed: Mar. 6, 1996

[30] Foreign Application Priority Data

Mar. 6, 1995 [JP] Japan ..... 7-045947

[51] Int. Cl.[6] ..... G03G 15/08

[52] U.S. Cl. ..... 399/284

[58] Field of Search ..... 399/222, 260, 399/258, 265, 273, 274, 279, 283, 284, 252, 285

[56] References Cited

U.S. PATENT DOCUMENTS

| | | | |
|---|---|---|---|
| 4,286,543 | 9/1981 | Ohnuma et al. . | |
| 4,537,491 | 8/1985 | Komada et al. . | |
| 4,755,847 | 7/1988 | Matsuhiro et al. | 399/284 |
| 5,012,285 | 4/1991 | Oka et al. . | |
| 5,634,182 | 5/1997 | Asanae et al. | 399/274 X |

FOREIGN PATENT DOCUMENTS

| | | |
|---|---|---|
| 50-117432 | 9/1975 | Japan . |
| 58-4160 | 1/1983 | Japan . |
| 2263789 | 8/1993 | United Kingdom . |

*Primary Examiner*—Shuk Lee

[57] ABSTRACT

A developing device attachable to and detachable from a printer using a non-magnetic monocomponent developer. Two different voltages are applied respectively to a developing roller and a toner layer thickness regulating device from a power source of the apparatus main body side through a terminal and a contacting spring. A voltage is applied directly to the developing roller from the contacting spring whereas a Zener diode is provided in a path connecting the contacting spring and toner layer thickness regulating device to apply another voltage to the toner layer thickness regulating device. The voltage applied to the toner layer thickness regulating device is dropped below the power supply voltage by the Zener voltage when a low-printing-ratio image is produced. Thus, the number of the terminals connecting the apparatus main body and developing device is reduced to one. Accordingly, defective connections at the contacting portions of the terminal can be prevented and the manufacturing costs can be reduced while a satisfactory image is produced.

35 Claims, 11 Drawing Sheets

DETACHABLE DEVELOPING DEVICE FOR PROVIDING FIRST AND SECOND VOLTAGES FOR AN IMAGE FORMING APPARATUS

FIELD OF THE INVENTION

The present invention relates to a developing device employed in an electrophotographic image forming apparatus, such as an optical printing device, a copying machine, and a facsimile.

BACKGROUND OF THE INVENTION

A typical image forming apparatus, an electrophotographic optical printing device, is disclosed in Japanese Laid-open Patent Application No. 50-117432.

This optical printing device carries out a printing operation in the following manner shown in FIG. 8. First, a static latent image is formed on a photosensitive drum 72 as the photosensitive drum 72 is irradiated and scanned by a laser beam 71 modulated in accordance with input data from a computer. Then, the static latent image on the photosensitive drum 72 is developed into a visible toner image with toner. The toner used herein is a non-magnetic monocomponent developer charged while it is withheld in a developing cartridge 73 serving as a developing device. Subsequently, the toner image on the photosensitive drum 72 is transferred onto a recording sheet by a transfer roller 74, and the recording sheet is released from the optical printing device through a fusing unit 75.

The developing cartridge 73, which is attachable to and detachable from the optical printing device, includes a developing roller 76 for transporting the toner to a developing area of the photosensitive drum 72, a toner layer thickness regulating member 77 for regulating the thickness of a toner layer by pressing the developing roller 76 through an unillustrated spring, a toner supplying roller 78 for supplying the toner to the developing roller 76, and a toner stirring roller 79 for transporting the toner to the toner supplying roller 78 while stirring the same within a developing reservoir.

Voltages having different values are applied to the toner layer thickness regulating member 77 and developing roller 76, respectively. It is arranged that a voltage applied to the toner layer thickness regulating member 77 is greater than a voltage applied to the developing roller 76 in absolute value. This is done so to charge the toner evenly by injecting the charges into the toner from the toner layer thickness regulating member 77.

Therefore, two terminals 80 and 82 are conventionally provided to connect the developing cartridge 73 and optical printing device main body to apply voltages having their respective absolute values to the developing roller 76 and toner layer thickness regulating member 77, respectively. In other words, voltages from a power source 81 are supplied to the toner layer thickness regulating member 77 through the terminal 80 and to the developing roller 76 through the terminal 82, respectively.

Another conventional example will be described in the following. In this example, a charger and a photosensitive body of the electrophotographic apparatus are made into a single unit cartridge attachable to and detachable from the electrophotographic apparatus main body, and two terminals are provided to connect the cartridge and the electrophotographic apparatus main body.

As shown in FIG. 9, a cartridge 90, which includes a corona charger 91 and a photosensitive drum 92, is a single unit attachable to and detachable from the electrophotographic apparatus main body. The corona charger 91 is provided with a tungsten wire 93 and a grid 96 for controlling a corona discharge to charge the photosensitive drum 92 evenly.

Two terminals 94 and 98 are provided to connect the cartridge 90 and the electrophotographic apparatus main body in such a manner that, when the cartridge 90 is attached to the electrophotographic apparatus main body, the tungsten wire 93 is electrically connected to a power source 95 of the electrophotographic apparatus main body through the terminal 94 while the grid 96 is connected to the ground through the terminal 98.

Note that a Zener diode 97, which is connected to the grid 96 at the cathode and to the terminal 98 at the anode, is provided between the grid 96 and terminal 98. When a Zener voltage of the Zener diode 97 is, for example, 800 V, then a voltage applied to the tungsten wire 93 from the power source 95 is in a range between −3 kV and −7 kV, and a voltage of the grid 96 is stabilized at −800 V under a corona discharge, thereby making it possible to control the corona discharge.

However, the optical printing device disclosed in the above Japanese Laid-open Patent Application No. 50-117432 readily causes paper jam. In addition, since the developing cartridge 73 is removed from and installed in the electrophotographic apparatus main body each time the optical printing device is cleaned, there easily occurs defective electrical connection at the contacting portions of the terminals 80 and 82, where the on/off state of the electrical connection is switched.

Similarly, the electrophotographic apparatus employing the above cartridge 90 readily causes defective electrical connection at the contacting portions of the terminals 94 and 98, because the cartridge 90 is also removed from and installed in the electrophotographic apparatus main body each time the tungsten wire 93 is cleaned in regular maintenance or the electrophotographic apparatus is cleaned.

Such defective connection at the contacting portions causes noises, which may further cause the malfunction of an electronic instrument if it is highly susceptible to noises.

Moreover, since the optical printing device disclosed in Japanese Laid-open Patent Application No. 50-117432 demands two systems and a plurality of terminals to supply voltages having different values from the power source 81, a resulting electrophotographic apparatus becomes expensive.

In view of the foregoing, it is well understood that (1) the defective connection occurs less frequently as the number of connecting portions at the terminals 80 and 82, or 94 and 98 is reduced, and (2) the manufacturing costs are reduced when the number of the terminals is reduced to one. Thus, there has been an increased need for a technique that reduces the number of the terminals to one while making it possible to supply two different voltages to the two systems, respectively.

SUMMARY OF THE INVENTION

It is therefore an object of the present invention to provide an inexpensive developing device, employed in an image forming apparatus, capable of (1) reducing the occurrence of a defective connection in the contacting portions at the terminals by reducing the number of terminals for electrically connecting a power source in an image forming apparatus main body side to the developing device to one while making it possible to supply two different voltages respectively to a developing roller and a toner layer thickness regulating device, and (2) producing a satisfactory image.

The above object is fulfilled by a developing device, employed in an image forming apparatus, for developing a static latent image formed on a photosensitive body (e.g., a photosensitive drum) including:

- a developer carrying body (e.g., a developing roller) for holding a developer layer on a surface thereof and for transporting a developer by physical contact with the photosensitive body, a constant first voltage being supplied to the developer carrying body from a power source of an image forming apparatus main body;
- a conductive developer layer thickness regulating device (e.g., a toner layer thickness regulating device), connected to the power source, for regulating the developer layer to a constant thickness by physical contact with the developer carrying body; and
- a constant voltage element (e.g., a Zener diode), provided in a path connecting the power source and the developer layer thickness regulating device, for applying a second voltage to the developer layer thickness regulating device by generating a constant voltage using a current generated in response to a balance between a surface potential of the photosensitive body and a potential of the power source, the second voltage being different from the first voltage.

According to the above first structure, when the image forming apparatus develops a static latent image with a developer by bringing the photosensitive body into contact with the developer carrying body and bringing the developer carrying body into contact with the developer layer thickness regulating device while applying two different voltages respectively to the developer carrying body and developer layer thickness regulating device, the surface potential of the photosensitive body changes in response to a printing ratio of a resulting image, and for this reason, a current corresponding to a balance between the surface potential of the photosensitive body and a potential of the power source is generated.

For example, in case of a developing device of a reversal development type where the developer is negatively charged and the photosensitive body and developer carrying body are brought into contact with each other, a current flows from the power source to the photosensitive body when developing a low-printing-ratio image, while a current flows in a reversed direction when developing a high-printing-ratio image.

The reason why is as follows. In case of a low-printing-ratio image, most of the surface of the photosensitive body remains non-exposed and a large amount of negative charges are accumulated on the surface. Thus, an overall surface potential of the photosensitive body is higher than the potential of the developer carrying body. Since the photosensitive body and developer carrying body are brought into contact with each other, the negative charges accumulated on the photosensitive body flow from a higher potential to a lower potential, that is, from the photosensitive body to the developer carrying body. Accordingly, a current flows from the power source to the photosensitive body.

In contrast, the major portion of the surface of the photosensitive body is exposed in case of a high-printing-ratio image, and most of the negative charges are eliminated. Thus, an overall surface potential of the photosensitive body is lower than the potential of the developer carrying body, and therefore the negative charges migrate from the developer carrying body to the photosensitive body. Accordingly, a current flows from the photosensitive body to the power source.

Therefore, in case of the developing device of the reversal development type, if the constant voltage element is designed to be activated to generate a voltage by a current flowing from the photosensitive body to the power source, the constant first voltage is applied to the developer carrying body from the power source, while the second voltage, which is in effect a balance between the voltage of the power source and the voltage generated by the constant voltage element, is applied to the developer layer thickness regulating device when developing a low-printing-ratio image.

In case of the developing device of a normal development type, the relation between the printing ratio and the direction of the current is inverse to the above case of the reversal development type.

That is to say, in case of the developing device of the normal development type, if the constant voltage element is designed to be activated by a current flowing from the power source to the photosensitive body, the constant first voltage is applied to the developer carrying body from the power source, while the second voltage, which is in effect a sum of the voltage of the power source and the voltage generated by the constant voltage element, is applied to the developer layer thickness regulating device when developing a high-printing-ratio image.

In short, in case of a low-printing-ratio image with which the fog readily appears on the white background, the constant voltage element generates, between the developer carrying body and developer layer thickness regulating device, a potential difference that enables the developer layer thickness regulating device to inject charges into the developer layer on the developer carrying body.

Thus, providing the constant voltage element in the path connecting the developer layer thickness regulating device and power source alone not only promotes the charging of the developer, but also eliminates the weakly or reversely charged developer, thereby making it possible to produce a satisfactory image in a stable manner.

When the developing device is attachable to and detachable from the image forming apparatus main body, voltages are supplied respectively to the developer carrying body and developer layer thickness regulating device both contained in the developing device from a single power source of the image forming apparatus main body. Thus, only one terminal is necessary to electrically connect the image forming apparatus main body and developing device.

Since the number of the terminals electrically connecting the image forming apparatus main body and attachable/detachable developing device is reduced compared with a conventional case, the defective connection in the connecting portions occurs less frequently when the developing device is repetitively attached to and detached from the image forming apparatus main body. Thus, the above structure enables a highly reliable, inexpensive developing device.

The above-structured developing device employed in the image forming apparatus is preferably arranged in such a manner that the constant voltage element is a Zener diode.

When a current exceeding a predetermined operating current flows through the Zener diode, the Zener diode generates a Zener voltage that remains at a constant level independently of the magnitude of the current. Therefore, although the connecting direction of the Zener diode must be switched depending on whether the developing device is of the reversal or normal development type, the Zener diode generates a Zener voltage, namely, a constant potential difference, between the developer carrying body and developer layer thickness regulating device when a low-printing-ratio image is developed, thereby enabling the developer layer thickness regulating device to inject the charges into the developer layer on the developer carrying body.

Since the Zener voltage can be changed depending on the magnitudes of the voltages applied to the photosensitive body and developer carrying body, it becomes easier to assemble the developing device capable of reducing the fog most effectively when developing a low-printing-ratio image.

The above-structured developing device employed in the image forming apparatus is preferably arranged in such a manner that the voltage generated by the constant voltage element an upper limit to keep a potential of the surface of the developer layer on the developer carrying body lower than a surface potential which the photosensitive body had when a developing process has started. As a result, an image with satisfactory quality can be produced.

To be more specific, when the constant voltage element generates an excessively high voltage, the potential difference between the developer carrying body and developer layer thickness regulating device becomes too large and an excessive amount of charges are injected into the developer layer on the developer carrying body. As a result, an amount of charges of the developer layer becomes too large and the potential of the surface of the developer layer exceeds the surface potential which the photosensitive body had when the developing process started. Given these conditions, since the charged developer migrates from a higher potential to a lower potential, the developer adheres not only to a static latent image on the photosensitive body, but also to the entire surface of the photosensitive body, thereby impairing the image quality considerably.

Therefore, if the voltage generated by the constant voltage element is set to have an upper limit to keep a potential of the surface of the developer layer on the developer carrying body lower than a surface potential which the photosensitive body had when a developing process started, the potential of the surface of the developer layer never exceeds the surface potential which the photosensitive body had when the developing process started. Thus, the developer adheres to the static latent image alone to develop the same, thereby making it possible to produce a satisfactory image with no fog.

Incidentally, in the above-structured developing device employed in the image forming apparatus, the developer is principally charged when the charges are injected from the developer layer thickness regulating device into the developer layer on the developer carrying body. However, the developer is also charged by friction when the photosensitive body and developer carrying body are brought into contact with each other. This indicates that the developer is charged more effectively by triboelectric charging if a transporting speed of the developer carrying body is accelerated.

It should be noted that, however, if the transporting speed is too high, the developer fuses onto the developer layer thickness regulating device, thereby presenting the developer layer thickness regulating device from forming a developer layer of even thickness on the developer carrying body. As a result, the image quality is impaired due to defects such as white streaks in a resulting image.

Therefore, the above-structured developing device employed in the image forming apparatus is preferably arranged in such a manner that a transporting speed of the developer carrying body is not as high as to fuse the developer onto the developer layer thickness regulating device but higher than a speed at which a surface of the photosensitive body moves when developing a static latent image.

Preventing the developer from fusing onto the developer layer thickness regulating device in this manner enables the developer layer thickness regulating device to make the developer into a layer of even thickness on the developer carrying body. Since such a developer layer of even thickness is transferred onto the photosensitive body, the charging efficiency of the developer can be enhanced while a satisfactory image can be produced without fail.

The above-structured developing device employed in the image forming apparatus is preferably arranged in such a manner that the absolute value of the surface potential of the photosensitive body is set higher than the absolute value of the potential of the developer carrying body by 100V–500V. As a result, a satisfactory image with no fog can be produced.

To be more specific, when the balance between the absolute value of the surface potential of the photosensitive body and the absolute value of the potential of the developer carrying body is too small, the surface potential of the developer layer on the developer carrying body readily exceeds the surface potential of the photosensitive body. Under these conditions, the developer adheres not only to a static latent image but also the other portions on the photosensitive body, thereby causing considerable fog on the white background of the resulting image. On the other hand, when the balance is too large, the photosensitive body can not resist the voltage and causes voltage leakage.

As has been explained, in the above-structured developing device employed in the image forming apparatus, the developer is also charged, albeit partly, by friction as the photosensitive body and developer carrying body are brought into contact with each other.

Therefore, it is preferable that the photosensitive body and developer are charged to polarities reversed of each other as a result of triboelectric charging.

Accordingly, the developer is charged more efficiently by triboelectric charging as the photosensitive body and developer carrying body touch each other while being charged evenly in a more secured manner, thereby making it possible to further reduce the fog.

The above object is also fulfilled by a developing device, employed in an image forming apparatus, for developing a static latent image formed on a photosensitive body (e.g., a photosensitive drum) including:

a developer carrying body (e.g., a developing roller) for holding a developer layer on a surface thereof and for transporting a developer by physical contact with the photosensitive body, a constant first voltage being supplied to the developer carrying body from a power source of an image forming apparatus main body;

a conductive developer layer thickness regulating device (e.g., a toner layer thickness regulating device), connected to the power source, for regulating the developer layer to a constant thickness by physical contact with the developer carrying body; and a potential difference generating element (e.g., a resistor or varistor), provided in a path connecting the power source and the developer layer thickness regulating device, for applying a second voltage to the developer layer thickness regulating device by generating a potential difference between the power source and the developer layer thickness regulating device using a current generated in response to a difference between a surface potential of the photosensitive body and a potential of the power source, the second voltage being different from the first voltage.

According to the second structure, like the first structure, a current corresponding to the balance between the surface potential of the photosensitive body and the potential of the power source flows between the developer layer thickness regulating device and power source in response to changes in printing ratio of a resulting image. The current flows also through the potential difference generating element provided between the developer layer thickness regulating device and power source. Thus, the constant first voltage is always applied to the developer carrying body from the power source, while the second voltage, which equals a sum of the voltage of the power source and the voltage generated by the potential difference generating element, is applied to the developer layer thickness regulating device. In short, in case of a low-printing-ratio image with which the fog readily appears on the white background, a potential difference that enables the developer layer thickness regulating device to inject the charges into the developer layer on the developer carrying body is generated between the developer carrying body and developer layer thickness regulating device.

As a result, like the first structure, the second structure makes it possible to charge the developer more efficiently and eliminate the weakly or reversely charged developer that causes the fog, thereby producing a satisfactory image in a stable manner.

When the developing device is attachable to and detachable from the image forming apparatus main body, voltages are supplied to the developing device from a power source of the image forming apparatus main body. Thus, only one terminal is necessary to electrically connect the image forming apparatus main body and developing device. Since the number of the terminals is reduced compared with a conventional case, the defective connection in the connecting portions occurs less frequently when the developing device is repetitively attached to and detached from the image forming apparatus main body. Thus, the second structure enables a highly reliable, inexpensive developing device.

The developing device of the second structure is preferably arranged in such a manner that the potential difference generating element is a resistor.

A potential difference across the resistor changes depending on the magnitude of a current flowing through the resistor. However, the balance between the surface potential and the potential of the power source becomes larger when developing a low-printing-ratio image, and the potential difference across the resistor becomes sufficiently large. Therefore, in case of a low-printing-ratio image with which the fog readily appears on the white background, a potential difference that enables the developer layer thickness regulating device to inject the charges into the developer layer on the developer carrying body is generated between the developer carrying body and developer layer thickness regulating device. In short, using the resistor is particularly effective in eliminating the fog in producing a low-printing-ratio image.

The developing device of the second structure employed in the image forming apparatus is preferably arranged in such a manner that the potential difference generating element is a varistor.

The potential difference generated across the varistor depends less on the magnitude of the current flowing through the varistor compared with the resistor. Therefore, not only the fog can be eliminated in a stable manner in a broader range of printing ratio compared with the resistor, but also a similar effect to the one realized by the first structure can be obtained.

The above object is also fulfilled by a developing device, employed in an image forming apparatus, for developing a static latent image formed on a photosensitive body (e.g., a photosensitive drum) including:

a developer carrying body (e.g., a developing roller) for holding a developer layer on a surface thereof and for transporting a developer by physical contact with the photosensitive body, a constant first voltage being supplied to the developer carrying body from a power source of an image forming apparatus main body;

a conductive developer layer thickness regulating device (a toner layer thickness regulating device), connected to the power source, for regulating the developer layer to a constant thickness by physical contact with the developer carrying body; and a constant voltage element (e.g., a Zener diode), provided in a path connecting the power source and the developer layer thickness regulating device, for applying a second voltage to the developer layer thickness regulating device by generating a constant voltage using a current running between the power source and the developer layer thickness regulating device, the second voltage being different from the first voltage, the developing device being attachable to and detachable from the image forming apparatus main body, the developing device being electrically connected to a power source of the image forming apparatus main body through a single junction terminal when attached to the image forming apparatus main body, the single junction terminal being composed of one terminal portion formed in a frame of the developing device and another terminal portion formed on the image forming apparatus main body, the one terminal portion and the other terminal portion being separable.

According to the third structure, different voltages can be applied respectively to the developer carrying body and developer layer thickness regulating device from a single power source only by providing a constant voltage element in the path connecting the developer layer thickness regulating device and power source. Thus, the power source has only one output terminal. Accordingly, only one junction terminal is necessary to electrically connect the power source of the apparatus main body and an attachable/detachable developing device.

As a consequence, when the developing device is a cartridge attachable to and detachable from the image forming apparatus main body, defective connection in the connecting portions occurs less frequently when the developing device is repetitively attached to and detached from the image forming apparatus main body. Therefore, the third structure enables a highly reliable, inexpensive developing device with low-running cost.

Also, since the constant voltage element is provided in the path connecting the power source and developer layer thickness regulating device, in case of a low-printing-ratio image with which the fog readily appears on the white background, the weakly or reversely charged developer can be eliminated in the same manner as the first structure, thereby making it possible to produce a satisfactory image in a stable manner.

For a fuller understanding of the nature and advantages of the invention, reference should be made to the ensuing detailed description taken in conjunction with the accompanying drawings.

BRIEF DESCRIPTION OF THE DRAWINGS

FIG. 3(*b*) is a schematic circuit diagram showing the equivalent circuit of FIG. 3(*a*);

FIG. 5(*b*) is a graph showing the relation between a surface potential of a photosensitive body and a printing ratio in the normal development type developing cartridge;

FIG. 6(*b*) is a graph showing the relation between an image density and a developing potential;

FIG. 6(*c*) is a graph showing the variance in potential where a photosensitive drum and a developing roller press against each other during a developing process;

DESCRIPTION OF THE EMBODIMENTS

Figure 5A:
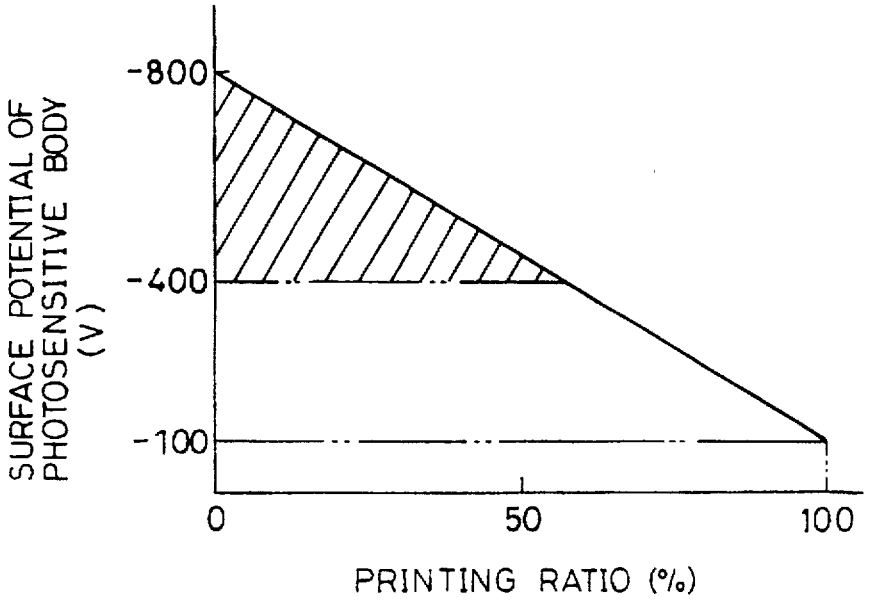
FIG. 5(*a*) is a graph showing the relation between a surface potential of a photosensitive body and a printing ratio in the reversal development type developing cartridge.
Figure 5B:
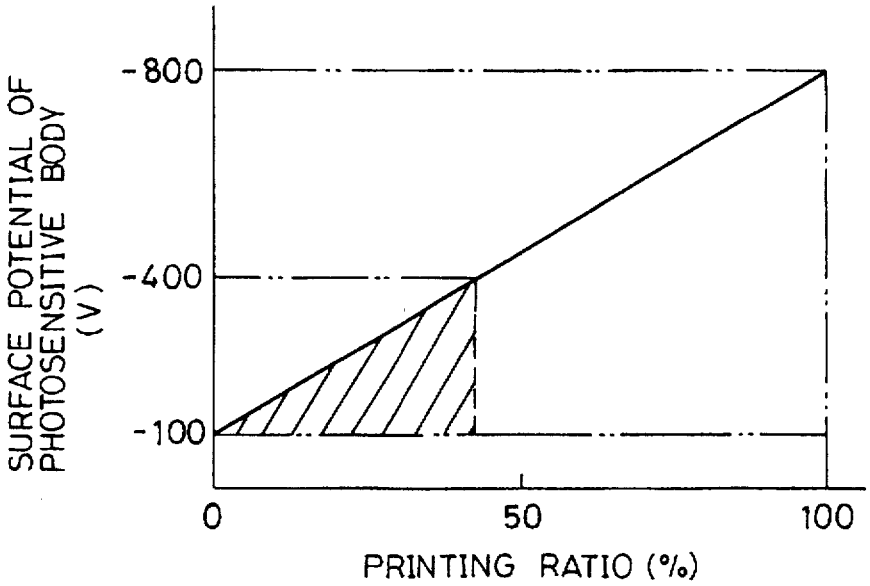
Figure 6A:
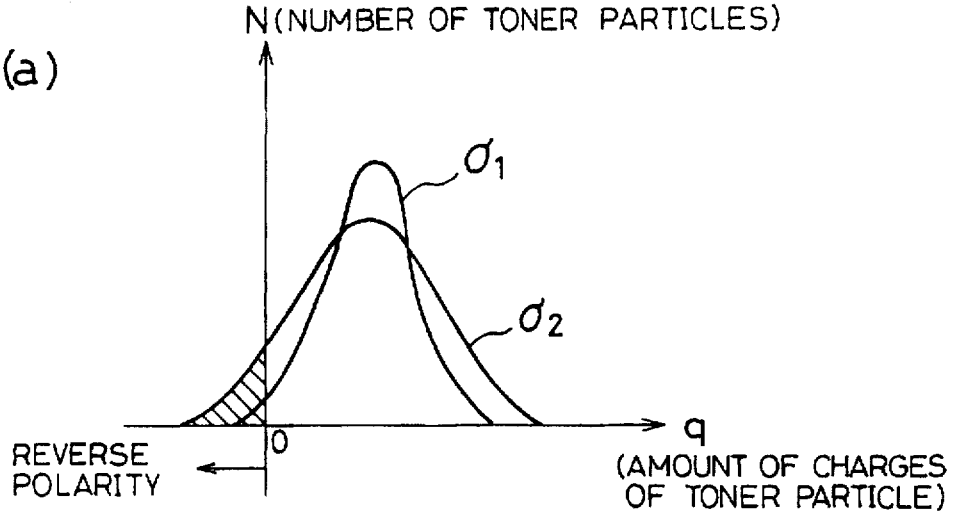
FIG. 6(*a*) is a graph showing a distribution of an amount of charges of a toner particle.
Figure 6B:
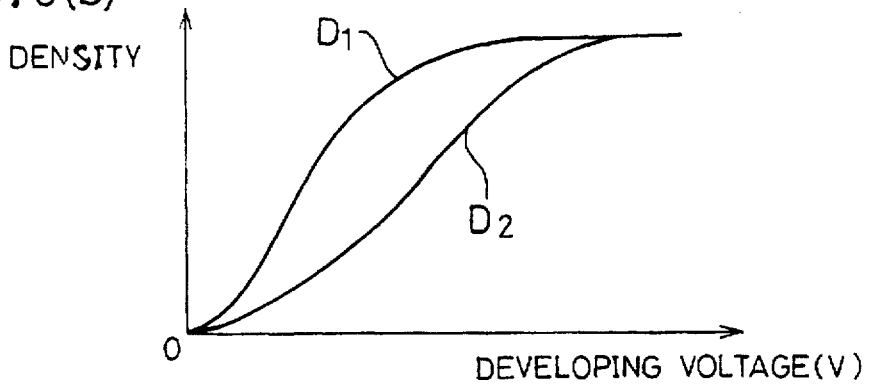
Figure 6C:
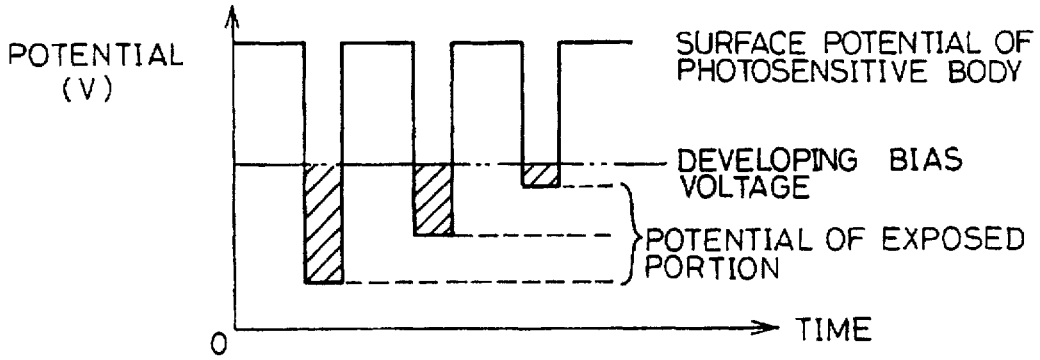

Referring to FIGS. 1 through 3, FIG. 5(*a*) and FIG. 6, the following description will describe a first embodiment in accordance with the present invention.

Figure 2:
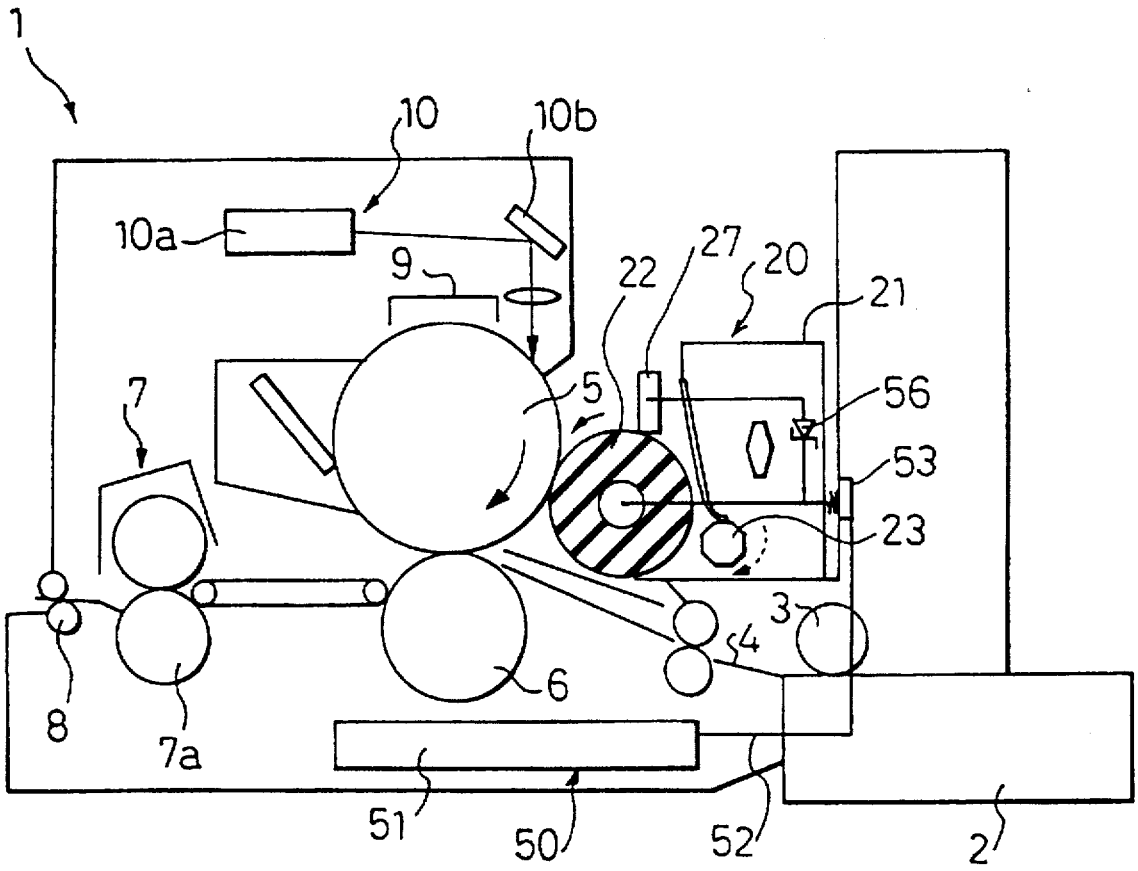
FIG. 2 is a schematic view showing the structure of the above image forming apparatus entirely.

As shown in FIG. 2, an optical printing device (hereinafter, referred to as the printer) representing an image forming apparatus in accordance with the present embodiment includes a sheet feeding tray section 2, attached to either side of the printer main body 1, for inserting an unillustrated recording sheet into the printer main body 1. A sheet feeding roller 3 is provided in the sheet releasing side of the sheet feeding tray section 2, and a substantially horizontal sheet transporting path 4 is made in the sheet releasing side of the sheet feeding roller 3. A photosensitive drum 5 serving as a photosensitive body and a transfer roller 6 are provided in the sheet transporting path 4.

Also, a fusing unit 7 having a fusing roller 7*a* is provided in the sheet releasing side of the transfer roller 6. Further, a sheet releasing roller 8 is provided in the sheet releasing side of the fusing roller 7, through which a recording sheet is released from the printer main body 1.

On the other hand, a developing cartridge 20 is provided in either side of the photosensitive drum 5 as a developing device and a non-magnetic monocomponent developer (developer), namely, toner, is supplied on the surface of the photosensitive drum 5. An optical unit 10 is provided above the photosensitive drum 5 to irradiate light beams onto the same.

The optical unit 10 encloses a semi-conductor laser device 10*a*, a reflecting mirror 10*b*, and the like. A ray emanated from the optical unit 10 is led to the surface of the photosensitive drum 5 which is pre-charged by the charger 9 and exposes the photosensitive drum 5. Accordingly, a latent image is formed on the surface of the photosensitive drum 5.

The latent image is developed into a toner image as the toner supplied from the developing cartridge 20 adheres to the photosensitive drum 5. The toner image thus formed on the surface of the photosensitive drum 5 is carried forward in a clockwise direction to a contacting portion of the photosensitive drum 5 and transfer roller 6 as the photosensitive drum 5 rotates.

At the same time, the recording sheets in the sheet feeding tray section 2 are carried forward per sheet by the sheet feeding roller 3. The recording sheet thus carried forward is further transported through the sheet transporting path 4 to a transfer area, namely, the contacting portion of the photosensitive drum 5 and transfer roller 6.

The toner image on the surface of the photosensitive drum 5 is transferred onto the recording sheet by the potential difference between the toner and the surface of the recording sheet while the recording sheet passes by the transfer area.

Subsequently, the recording sheet is sent to the fusing unit 7 having the fusing roller 7*a* and heated while being pressed against the fusing unit 7. Thus, the toner on the recording sheet is fused onto the recording sheet by the temperature of and pressure from the fusing roller 7*a*. The recording sheet having passed the fusing unit 7 is released from the printer main body 1 by the sheet releasing roller 8.

Figure 1:
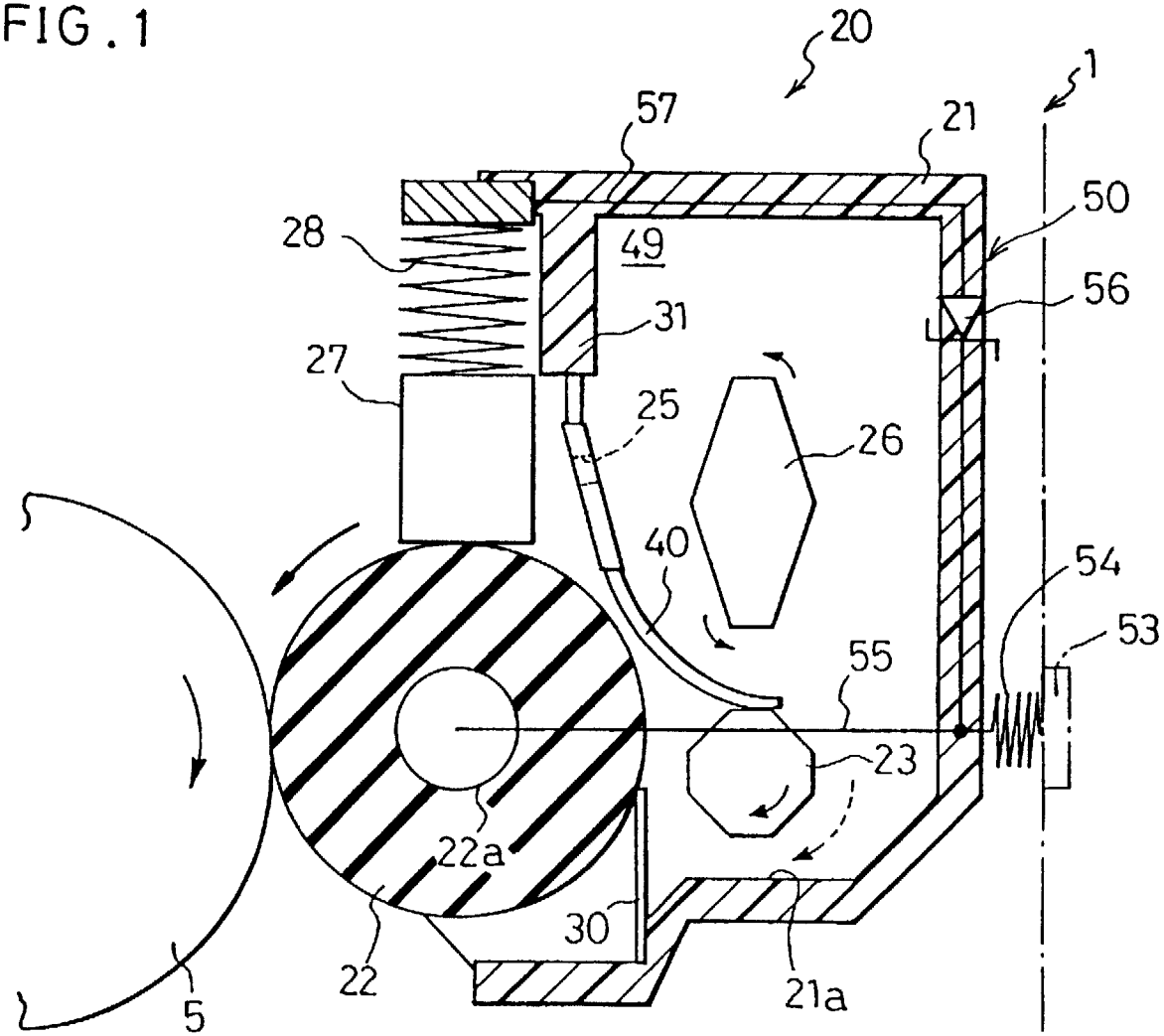
FIG. 1 is a view showing an example structure of a developing cartridge employed in an image forming apparatus in accordance with the present invention.

Incidentally, as shown in FIG. 1, the developing cartridge 20 of the present embodiment includes a cartridge main body 21 (frame of the developing device) having a developing reservoir 49. The developing reservoir 49 encloses a developing roller 22 (developer carrying body) for supplying the toner to the surface of the photosensitive drum 5, a toner supplying roller 23 (developer supplying member) for supplying the toner to the developing roller 22 at a predetermined transporting pressure, a toner stirring roller 26 for stirring the toner withheld in the developing reservoir 49, etc. Although it is not shown in the drawing, the axes of the developing roller 22, toner supplying roller 23, and toner stirring roller 26 are supported individually by bearings provided in the cartridge main body 21, and each roller is driven by an unillustrated driving gear in the direction indicated by an arrow.

The developing cartridge 20 further includes a toner layer thickness regulating member 27 (developer layer thickness regulating member) for regulating the thickness of the toner layer adhering to the surface of the developing roller 22 to a constant value, a spring 28, a bottom sealing material 30, a cartridge cover 31, etc. The spring 28 is used to press the toner layer thickness regulating member 27 against the developing roller 22. The bottom sealing material 30 is always brought into contact with the developing roller 22 to prevent toner leakage through the bottom portion of the developing roller 22.

Within the above-structured developing cartridge 20, the toner within the developing reservoir 49 is transported to the toner supplying roller 23 side by the toner stirring roller 26, and transported further to the developing roller 22 side through a section between the toner supplying roller 23 and an opposing internal wall surface 21*a* of the cartridge main body 21. The toner thus transported adheres to the developing roller 22 and is made into a layer of even thickness by the toner layer thickness regulating member 27. A static latent image on the photosensitive drum 5 is developed as the toner layer is attracted to the photosensitive drum 5 electrostatically.

The developing cartridge 20 is attachable to and detachable from the printer main body 1. To be more specific, the developing cartridge 20 is pushed downward over the printer main body 1 to engage both ends of an axis section 22*a* of the developing roller 22 of the developing cartridge 20 with an unillustrated guiding groove of the printer main body 1 when it is installed, and lifted upward to release the engagement when removed.

Next, the developing cartridge 20 will be described in detail.

In case that a non-magnetic monocomponent developer is used, the developing roller 22 is pressed against the photosensitive drum 5 to secure a predetermined nip (crossover). For this purpose, it is preferable to make the developing roller 22 out of a conductive, resilient rubber material. For example, adding conductive particulate, such as carbon, to a resilient material, such as urethane rubber of urethane-based rubber, silicon-based rubber or NBR (Nitrile-Butadiene Rubber)-based rubber, can render conductivity to the resilient material.

A preferable hardness of the developing roller 22 is in a range between 50° and 90° in ASKER C. The ASKER C indicates the hardeners of a sample which is measured by a hardness measuring device (a macro-molecule measuring instrument) produced in accordance with the standard (SRIS 0101) of Japanese Rubber Association. Specifically, the hardness measuring device indicates the hardness of a sample by pressing a ball-point needle designed for hardness measurement against a surface of the sample using a force of a spring and measuring the depth of indentation produced by the needle when the resistive force of the sample and the force of spring balance. With the standard of ASKER C, when the depth of indentation produced by the needle with the application of load of 55 g on the spring becomes equal to the maximum displacement of the needle, the hardness of the sample is indicated as zero degree. Also, when the depth of indentation produced by the application of load of 855 g is zero, the hardness of the sample is indicated as one hundred degree.

The toner supplying roller 23 for transporting and supplying the toner to the developing roller 22 is provided around the developing roller 22 in such a manner to avoid direct contact. The toner supplying roller 23 is a regular polyprism, and it is preferable that the polygonal face has three to eight sides in terms of transporting an adequate amount of toner, and a regular octagonal prism is used in the present embodiment. To be more specific, it is the side surfaces of the regular polyprism serving as the toner supplying roller 23 that transport the toner. Therefore, an amount of toner transported by the toner supplying roller 23 can be calculated as a balance in volume between the regular polyprism and a cylinder circumscribed thereto. Thus, the more the number of the sides, the less the transporting ability. However, if a regular polyprism has too few sides, the toner can not be transported in a stable manner. It is understood for this reason that a preferable number of the sides of the regular polyprism to stabilize toner transportation is in a range between five and eight inclusive.

More specifically, in case of non-magnetic monocomponent toner, if the diameter and peripheral speed of the developing roller 22 are set, for example, to 16 mm and 32.5 mm/sec., respectively, then the toner supplying roller 23 is a regular octagonal prism and the diameter and peripheral speed thereof are set to 12 mm and 40 mm/sec, respectively.

Incidentally, a toner applying member 40 is provided between the developing roller 22 and toner stirring roller 26 with its convex surface opposing the developing roller 22. Either end of the toner applying member 40 is attached to the cartridge cover 31, and the other end thereof, a so-called free end, extends downward and is brought into contact with the surface of the toner supplying roller 23 to scrape off the toner adhering to the same. The convex surface of the toner applying member 40 opposes the developing roller 22 and serves as a partition to divide the developing reservoir 49 into two sides: the toner layer thickness regulating member 27 and developing roller 22 side and the other components side.

The operation of the developing cartridge 20 when the toner applying member 40 is employed will be described below.

The toner within the developing cartridge 20 is transported downward to the toner supplying roller 23 side as the toner stirring roller 26 rotates. Next, the toner is transported to the developing roller 22 side through a section between the toner supplying roller 23 and opposing internal wall surface 21*a* as the toner supplying roller 23 rotates clockwise. At the same time, the contacting portion of the toner applying member 40 scrapes off the toner on the toner supplying roller 23 at the top thereof.

The toner transport ed to the developing roller 22 side and the toner scraped off by the contacting portion of the toner applying member 40 are further transported to a section between the developing roller 22 and the circular arc convex surface of the toner applying member 40 as the developing roller 22 rotates counterclockwise. As a result, a pressure of the toner with respect to the surface of the developing roller 22 can be raised to such an extent that allows the toner to form a layer on the developing roller 22 in a stable manner. W hen the toner is transported to the toner layer thickness regulating member 27 as the developing roller 22 rotates, the extra toner is scraped off by the toner layer thickness regulating member 27, thereby making it possible to form a thin toner layer of even thickness. Further, the toner layer thus formed is supplied to the photosensitive drum 5 as the developing roller 22 rotates, and a static latent image (not shown) on the photosensitive drum 5 is developed into a toner image.

The extra toner scraped off by the toner layer thickness regulating member 27 is returned to the toner stirring roller 26 side through a hole 25 made through the toner applying member 40. Therefore, although the extra toner is steadily transported to the section between the developing roller 22 and toner applying member 40, such extra toner is released through the hole 25, thereby preventing a pressure of the toner from rising more than necessary.

Next, the toner layer thickness regulating member 27 will be described in detail.

The toner layer thickness regulating member 27 presses the developing roller 22 through the spring 28 at, for example, 800 gf. When the pressure is insufficient, the thickness of the toner layer is not regulated adequately, while if the pressure is too strong, the toner may fuse onto the toner layer thickness regulating member 27. A preferred pressure of the toner layer thickness regulating member 27 against the developing roller 22 is, therefore, in a range between 500 gf and 2000 gf, and the most preferred range is between 700 gf and 1200 gf.

Although it will be described below, a voltage is applied to the toner layer thickness regulating member 27 from a voltage applying device 50 to charge the toner transported through the section between the toner layer thickness regulating member 27 and developing roller 22 by injecting charges into the toner. For this purpose and to carry out the same in a stable manner, the toner layer thickness regulating member 27 is made of a conductive material, and the reason why is as follows. The potential of the toner layer thickness regulating member 27 is readily stabilized at a certain level when it is made of a conductive material. Whereas when the toner layer thickness regulating member 27 is made of an insulating material, the potential is not released to anywhere and rises at a specific location. As a result, the toner can not be charged in a stable manner and the image quality is degraded because of the fog. Aluminium, iron, and conductive resin are preferable as the conductive material of the toner layer thickness regulating member 27.

As shown in FIG. 2, the voltage applying device 50 includes a power source 51 provided below the printer main body 1 and a wire 52 extending from the power source 51. The wire 52 is connected to a terminal 53 (another terminal portion) provided in a surface of the printer main body 1 opposing the developing cartridge 20.

Also, as shown in FIG. 1, the voltage applying device 50 further includes a contacting spring 54 (a terminal portion), a voltage applying line 55 for the developing roller 22, and a voltage applying line 57 for the toner layer thickness regulating member 27. More precisely, when the developing cartridge 20 is attached to the printer main body 1, the contacting spring 54 is brought into contact with the terminal 53. The voltage applying line 55 connects the contacting spring 54 and a metal axis section 22*a* of the developing roller 22 while the voltage applying line 57 serves as a connection path connecting the contacting spring 54 and the toner layer thickness regulating member 27 through the Zener diode 56 and spring 28.

Note that the terminal 53 and contacting spring 54 constitute a junction terminal. The cathode and anode of the Zener diode 56 are connected to the spring 28 and contacting spring 54, respectively. The Zener diode 56 and voltage applying line 57 are embedded in the wall of the cartridge main body 21.

Accordingly, a constant developing bias voltage (DBV) (first voltage) ranging from −400 V to −300 V is applied to the developing roller 22 from the voltage applying device 50 through the wire 52, terminal 53, contacting spring 54, and voltage applying line 55. On the other hand, while the Zener diode 56 operates, a voltage (second voltage), which is kept lower than the developing bias voltage by a Zener voltage, is applied to the toner layer thickness regulating member 27 through the wire 52, terminal 53, contacting spring 54, Zener diode 56, and voltage applying line 57.

The photosensitive drum 5 is charged to have a certain potential ranging from, for example, −800 V to −600 V, by the charger 9 when a static latent image is developed.

In case that the above-structured developing cartridge 20 is of the reversal development type that forms a static latent image on the surface of the photosensitive drum 5 by eliminating the potential of the exposed portion to attract the toner electrostatically, when the initial potential of the surface of the photosensitive drum 5 is set to −800 V and the toner is negatively charged, the surface potential of the photosensitive drum 5 decreases linearly as the printing ratio of a resulting image increases as shown in FIG. 5(*a*). The printing ratio referred herein is equal to a toner adhering ratio in a line on the surface of the photosensitive drum 5 along the axial direction.

In short, in case of the reversal development type developing cartridge, the lower the printing ratio, the more the non-exposed portion, thereby reducing the loss of the negative charges. As a result, the surface potential of the photosensitive drum 5 approximates to the initial potential (−800 V). Whereas the higher the printing ratio, the more the exposed portion, thereby increasing the loss of the negative charges. As a result, the surface potential of the photosensitive drum 5 approximates to an exposing potential (for example, −100 V).

Incidentally, the lower the printing ratio, the more the white background. Thus, there readily occurs a phenomenon known as the fog, in which toner adheres to a spot in the white background undesirably. The cause of the fog is the toner charged to a reversed polarity, namely, positively charged toner. It is generally known that the toner is readily charged to a reversed polarity when a charging controller is not dispersed satisfactorily within the primary resin of the toner. However, the toner is in effect charged to a reversed polarity through triboelectric charging among the toner particles rather than the unsatisfactorily dispersement of the charging controller.

The relation between the dispersibility of the charging controller and generation of the reversely charged toner will be briefly described with reference to FIG. 6(*a*). The vertical line and horizontal line of the graph in FIG. 6(*a*) represent the number N of the toner particles and an amount q of charges of each toner particle, respectively. The polarity is reversed in the left side of the vertical line. Curved lines $\sigma_1$ and $\sigma_2$ represent the relations between the number N of the toner particles and the amount q of charges of each toner particle when the charging controller renders good dispersibility and poor dispersibility, respectively. The graph reveals that, when the charging controller renders poor dispersibility, the distribution of the charged toner expands. As a result, a hatched area representing the reversed polarity increases, and so does the number of the toner particles charged to a reversed polarity.

Therefore, it is understood that to control the generation of the reversely charged toner, a negative voltage applied to the toner layer thickness regulating member 27 is set to have a greater value in the negative side than the negative developing bias voltage applied to the developing roller 22. Accordingly, the negative charges are injected into the toner passing by the contacting portion of the toner layer thickness regulating member 27 and developing roller 22 from the toner layer thickness regulating member 27.

This is the reason why the conventional electrophotographic apparatus is provided with two terminals connecting the developing cartridge and apparatus main body to supply two different voltages to the developing cartridge through the two terminals. In contrast, as previously mentioned, only one junction terminal, composed of the terminal 53 and contacting spring 54, is provided to connect the developing cartridge 20 and printer main body 1 to apply a constant voltage of, for example, −400 V, to the terminal 53 in the present invention.

The Zener diode 56 plays an important role as a constant voltage element that makes it possible to apply two different voltages respectively to the toner layer thickness regulating member 27 and developing roller 22 while applying a constant voltage to the terminal 53 alone.

For better understanding, an example structure of an equivalent circuit for supplying voltages respectively to the toner layer thickness regulating member 27 and developing roller 22 will be explained first, and thence the operation of the Zener diode 56 will be described.

Figure 3A:
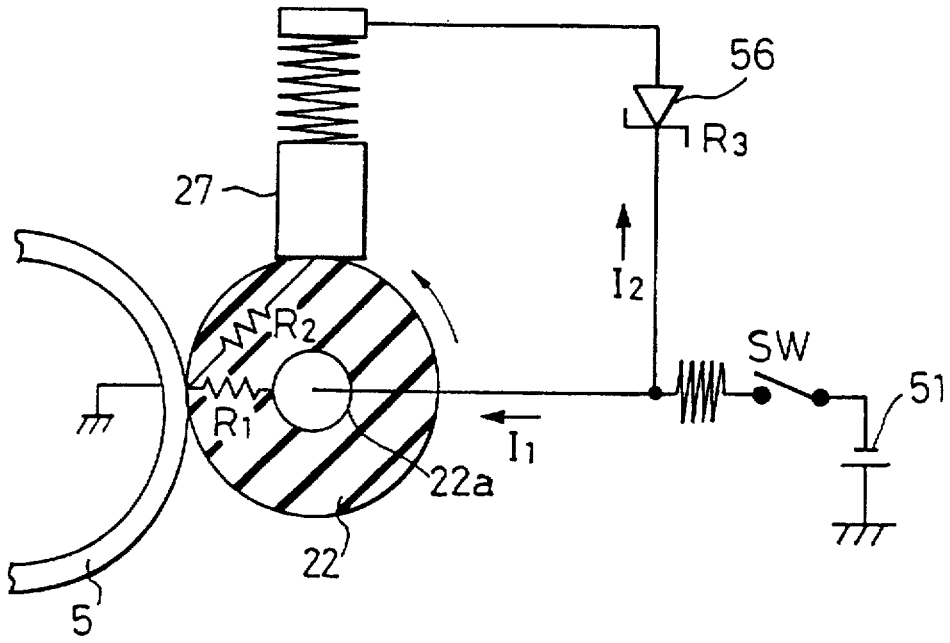
FIG. 3(*a*) is a schematic view explaining the operation of a Zener diode in a reversal development type developing cartridge.
Figure 3B:
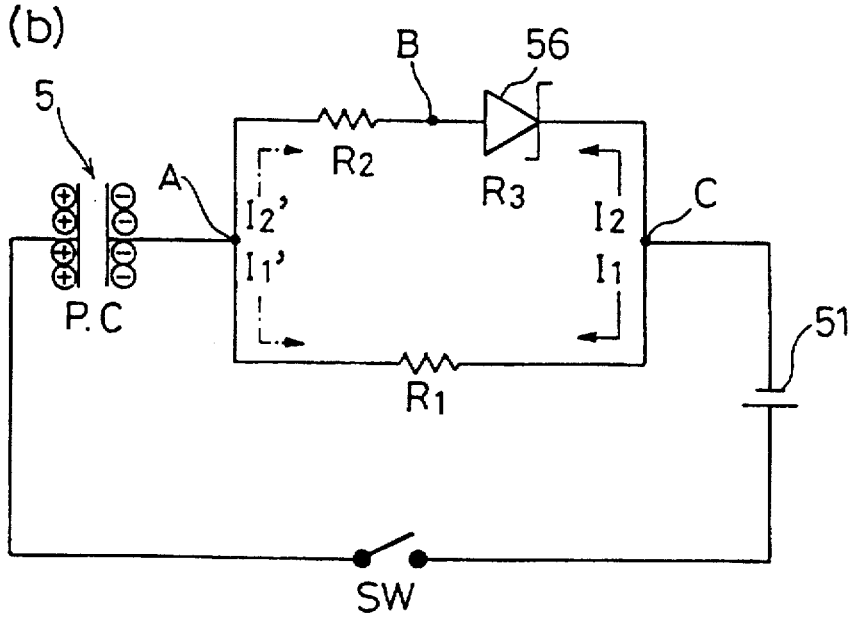

As shown in FIG. 3(*a*), let $R_1$, $R_2$, and $R_3$ be a resistor between the axis portion 22*a* of the developing roller 22 and the photosensitive drum 5, a resistance between the toner layer thickness regulating member 27 and the surface of the photosensitive drum 5, and a resistance of the Zener diode 56 before breakdown, respectively. The back side of the photosensitive layer of the photosensitive drum 5 is grounded, and thus assumed as playing a role of a condenser for accumulating the charges. An equivalent circuit comprising the photosensitive drum 5, developing roller 22, toner layer thickness regulating member 27, Zener diode 56, and power source 51 is of the structure as shown in FIG. 3(*b*). Here, a switch SW comes on the instant at which a charged portion of the photosensitive drum 5 touches the developing roller 22.

To be more specific, the resistors $R_1$, $R_2$, and $R_3$ have the following values, respectively:

$$R_1 \cong R_2 \cong 10^7\ \Omega$$

$$R_3 \cong 10^9 - 10^{10}\ \Omega$$

As previously explained with reference to FIG. 5(*a*), in case of a low-printing-ratio image with which the fog readily appears on the white background, a large amount of negative charges are accumulated on the surface of the photosensitive drum 5. Thus, the surface potential of the photosensitive drum 5 has a greater value than the developing bias voltage of the developing roller 22 in the negative side. For example, let the surface potential of the pre-exposed photosensitive drum 5 be −800 V, and the developing bias voltage be −400 V, then the surface potential of the photosensitive drum 5 where most of the portion remains non-exposed is in the range between −800 v and −400 V. Accordingly, the current $I_1$, and $I_2$, each having a value corresponding to the potential difference between the power source 51 and photosensitive drum 5, flow in a direction from the power source 51 to the photosensitive drum 5 through the resistance $R_1$ and through the Zener diode 56 and resistance $R_2$, respectively.

Immediately after the switch SW comes on, the resistance value $R_3$ of the Zener diode 56 is expressed as: $R_3 > R_2$. Then, an applied voltage to the Zener diode 56 is expressed as:

|the surface potential of the photosensitive drum 5 −the potential of the developing roller 22|. However, the Zener diode 56 causes breakdown when the current running through the Zener diode 56 exceeds the operating current of the same, and generates a constant Zener voltage. Accordingly, the voltage applied to the toner layer thickness regulating member 27 is stabilized at a lower level than the developing bias voltage by the Zener voltage. Consequently, the toner is charged in a stable manner as the negative charges are injected into the toner on the developing roller 22 from the toner layer thickness regulating member 27, thereby making it possible to produce a satisfactory image without any fog.

The hatched area in FIG. 5(*a*) corresponds to a printing ratio range where the surface potential of the photosensitive drum 5 has a greater value than the developing bias voltage of the developing roller 22 in the negative side and the Zener diode 56 operates. Note that, however, when a balance between the surface potential of the photosensitive drum 5 and the developing bias voltage is too small, the current $I_2$, flowing through the Zener diode 56 drops below the operating current of the Zener diode 56, thereby disabling the Zener diode 56 from generating the Zener voltage.

On the other hand, in case of a high-printing-ratio image, a major portion of the surface of the photosensitive drum 5 is exposed and a greater amount of the negative charges are eliminated by exposure. Thus, the surface potential of the photosensitive drum 5 has a greater value than the developing bias voltage of the developing roller 22 in the positive side. In other words, the surface potential of the photosensitive drum 5 is in a range between −400 V and 0V. Accordingly, in contrast to the case of a low-printing-ratio image, a current $I_1'$ flows to the power source 51 from the photosensitive drum 5 through the resistor $R_1$, while a current $I_2'$ flows to the power source 51 from the photosensitive drum 5 through the resistor $R_2$ and Zener diode 56 and prevents the generation of the Zener voltage.

Thus, according to the present invention, in case of a low-printing-ratio image with which the fog readily appears on the white background, the Zener voltage is generated so that the charges are injected into the toner by the toner layer thickness regulating member 27 to eliminate the weakly or reversely charged toner, while in case of a high-printing-ratio image with which the white background is limited and the fog is almost negligible, no Zener voltage is generated and no control is performed as to the reversely charged toner.

To make the effects of the present embodiment obvious, following six experiments were carried out.

(First Experiment)

The fog and developing memory at various printing ratios were examined using an optical printing device of the present embodiment in which two different voltages were applied respectively to the toner layer thickness regulating member 27 and developing roller 22 through the terminal 53 alone, and the result of which is set forth in TABLE 1 below. Also, the fog and developing memory at various printing ratios were examined using the conventional optical printing device in which two different voltages were applied to the toner layer thickness regulating member 27 and developing roller 22 through their respective terminals as a comparative experiment, and the result of which is set forth in TABLE 2 below. Note that the developing memory referred herein means a toner pattern that appears periodically on the surface of the developing roller 22, and such a pattern appears frequently when the toner is charged insufficiently. Also note that a mark ⊙ in TABLES 1 and 2 means the result was satisfactory through visual check.

TABLE 1

| PRINTING RATIO | 5% | 10% | 30% | 60% |
|---|---|---|---|---|
| FOG | ⊙ | ⊙ | ⊙ | ⊙ |
| DEVELOPING MEMORY | ⊙ | ⊙ | ⊙ | ⊙ |

TABLE 2

| PRINTING RATIO | 5% | 10% | 30% | 60% |
|---|---|---|---|---|
| FOG | ⊙ | ⊙ | ⊙ | ⊙ |
| DEVELOPING MEMORY | ⊙ | ⊙ | ⊙ | ⊙ |

TABLES 1 and 2 reveal that the voltage applying method of the present invention realizes substantially the same effect as the conventional method as to the prevention of the fog in the white background.

As has been explained, the developing cartridge 20 in the optical printing device of the present embodiment uses the terminal 53 alone for supplying voltages to the developing cartridge 20 side from the printer main body 1 side only if the Zener diode 56 is connected to the toner layer thickness regulating member 27. As a result, the defective connection in the contacting portions between the contacting spring 54 and terminal 53 in the developing cartridge 20 side can be curbed, thereby making it possible to produce a satisfactory image in a stable manner. Also, since the developing cartridge 20 uses only one system composed of the power source 51, wire 52, and terminal 53, a less expensive optical printing device can be assembled.

(Second Experiment)

Next, an optimal range of the Zener voltage was examined, and the result of which will be described below.

The developing roller 22 used herein includes a magnetic material inside, and has a diameter of 20 mm and a peripheral speed of 50 mm/sec. and was pressed against the surface of the photosensitive drum 5 at 1 kgf. On the other hand, the toner layer thickness regulating member 27 was pressed against the surface of the developing roller 22 at 500 gf. The toner supplying roller 23 has a diameter of 15 mm and a peripheral speed of 40 mm/sec. Also, a developing bias voltage of −300 V was applied to the developing roller 22 from the power source 51 through the terminal 53 and contacting spring 54.

The fog in the white background was examined under the above conditions while the Zener voltage of the Zener diode 56 was changed, and the result of which is set forth in TABLE 3 below. The fog was examined in the following manner. Reflectance R of a sheet was measured with a measuring device, namely, a photometer. The reflectance R represents a percentage of a light amount I reflected by the sheet out of an overall light amount $I_0$ irradiated to the sheet. The least reflectance R of a normal paper is about 85%, and that of a high-quality paper is about 95%. The reflectances R of the pre- and post-printing sheet were measured, and the post-printing reflectance $R_1$ was subtracted from the pre-printing reflectance $R_0$. A balance value k thus found is used to indicate the degree of the fog. When k is 1 or more, a resulting image is judged as being unsatisfactory with considerable fog.

TABLE 3

| ZENER VOLTAGE (V) | 10 | 50 | 100 | 300 | 500 | 700 |
|---|---|---|---|---|---|---|
| FOG k | 0.9 | 0.7 | 0.5 | 0.5 | 0.5 | 1.5 |

TABLE 3 reveals that a preferable range for the Zener voltage is between 10 V and 500 V in terms of preventing the fog, and a range between 50 V and 500 V is particularly preferable.

When the Zener voltage is too low, the potential difference between the toner layer thickness regulating member 27 and developing roller 22 becomes insufficient and so does the charge injection to the toner on the developing roller 22 from the toner layer thickness regulating member 27. As a result, weakly or reversely charged toner can not be eliminated sufficiently and considerable fog appears on the white background.

On the other hand, when the Zener voltage is too high, there occur two following problems. In the first place, the density of a toner image is reduced and so is the density of a resulting image, and the reason why is as follows. A constant potential difference, which is determined by a capacity of the photosensitive drum 5 and a capacity between the photosensitive drum 5 and developing roller 22, is generated around the contacting portion of the charged photosensitive drum 5 and the developing roller 22 to which the developing bias voltage is applied. Also, a total amount of accumulative charges is determined fixedly corresponding to that potential difference. Thus, when the Zener voltage is too high, the amount of charges of individual toner particle increases while the total amount of accumulative charges remains the same. Accordingly, the number of the toner particles which can migrate to the photosensitive drum 5 from the developing roller 22 is reduced, thereby reducing the density of the toner image.

FIG. 6(*c*) shows variance in potential in the contacting portion of the photosensitive drum 5 and developing roller 22 in time series. As is shown in the drawing, the potential of the exposed portion of the photosensitive drum 5 approximates to the surface potential of the non-exposed portion as the toner migrates from the developing roller 22 to the photosensitive drum 5, thereby reducing the balance between the developing bias voltage and the potential of the exposed portion. When the balance between the developing bias voltage and the potential of the exposed portion, that is, a developing potential, becomes nil, the toner stops migrating from the developing roller 22 to the photosensitive drum 5 and the developing process ends. If individual toner particles have an increased amount of charges, the developing potential drops to nil when only a small amount of toner has migrated, thereby ending the toner migration before the image is fully developed.

FIG. 6(*b*) shows the relation between the density of a toner image and the above-explained developing voltage. Curved line $D_1$ and $D_2$ represent when the toner particle has a small amount of charges and a large amount of charges, respectively. As the developing voltage increases, the density of a toner image increases up to saturation. However, the toner having a large amount of charges undesirably prevents an increase of the density of the toner image as has been explained. Therefore, the curved line $D_2$ always lies under the curved line $D_1$.

In the second place, the toner adheres to the non-exposed portion of the surface of the photosensitive drum 5 entirely. The reason why is as follows. The toner layer adhering to the developing roller 22 is made into either a double- or triple-layer of even thickness by the toner layer thickness regulating member 27. Given a developing bias voltage of −400 V when an amount of charges of each toner particle is 15 μC/g, then the surface potential of the toner layer ranges from −500 V to −700 V. However, when the Zener voltage is too high and the toner particle has an excessive amount of charges, the surface potential of the toner layer exceeds −800 V, which is the surface potential of the non-exposed portion of the photosensitive drum 5, thereby allowing the toner to adhere to the non-exposed portion entirely.

As has been explained, the image quality is degraded when the Zener voltage is either too high or low. Thus, the Zener voltage must be in a range between 10 V and 500 V to produce a satisfactory image in a stable manner.

(Third Experiment)

Next, the relation between the fog and a balance between the absolute value of the surface potential of the photosensitive drum 5 and the absolute value of the potential of the developing roller 22 was examined while the surface potential of the evenly charged photosensitive drum 5 was changed, and the result of which is set forth in TABLE 4 below and FIG. 10.

The developing roller 22, which presses the photosensitive drum 5 with a constant nip, is made of a resilient silicone rubber material having a hardness of 70° in ASKER C. The developing roller 22 has a peripheral speed of 20 mm/sec. and a resistance value of $10^7$ Ω–$10^8$ Ω. A developing bias voltage of −300 V was applied to the developing roller 22. The toner layer thickness regulating member 27 is made of a conductor, namely, aluminium, and the Zener diode 56 used herein can generate a Zener voltage of 100 V

TABLE 4

| BALANCE IN ABSOLUTE VALUE (V) | 0 | 100 | 200 | 300 | 400 | 500 | 600 | 1000 |
|---|---|---|---|---|---|---|---|---|
| FOG | 1.0 | 0.7 | 0.5 | 0.5 | 0.5 | 0.8 | 1.8 | 2.0 |

Figure 10:
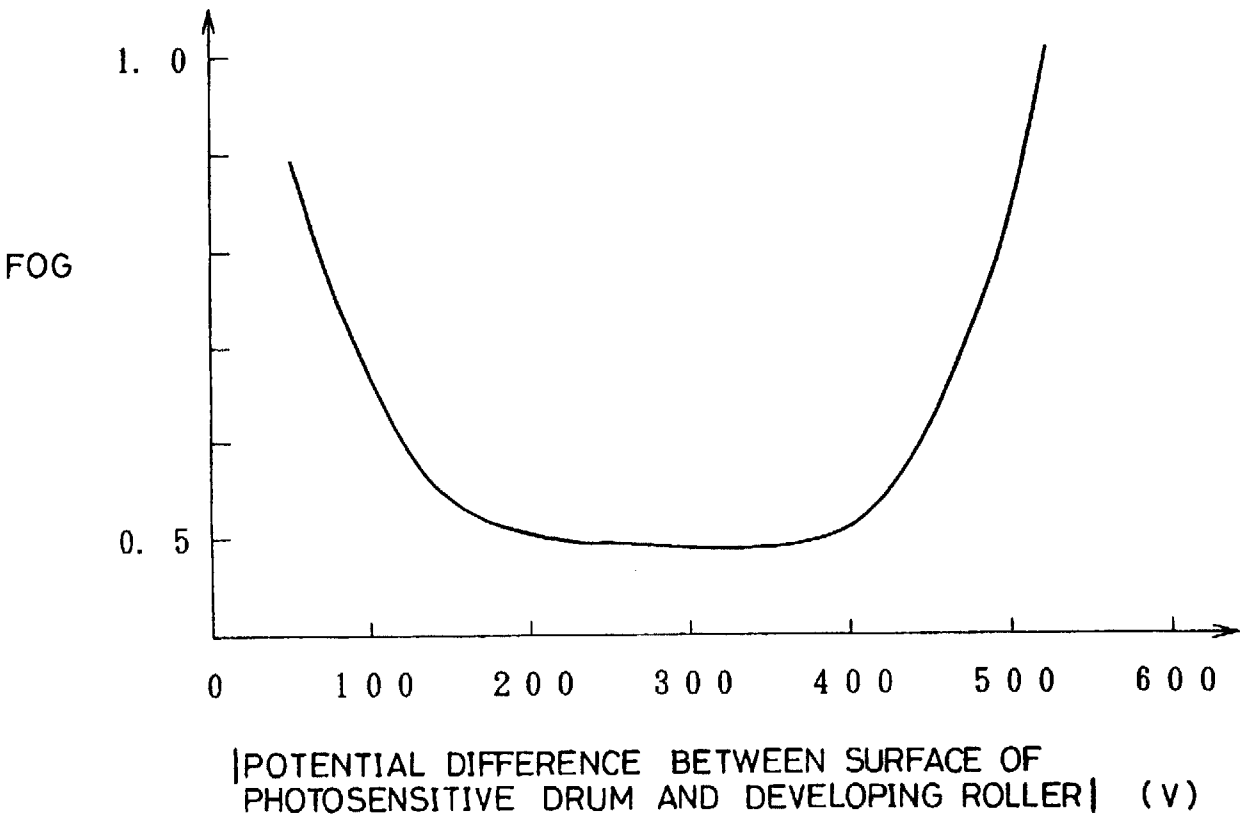
FIG. 10 shows a characteristic curve showing the relation between the fog and a potential difference between the surface of the photosensitive body and developing roller in the electrophotographic apparatus of the present invention.

TABLE 4and the characteristics curves shown in FIG. 10 reveal that the fog is almost negligible when the balance between the absolute value of the surface potential of the photosensitive drum 5 and the absolute value of the potential (developing bias voltage) of the developing roller 22 is in a range between 100 V and 500 V.

The reason why the fog increases when the balance is either too small or large is as follows.

On the developing roller 22, there exists a mixture of negatively charged toner having a normal amount of charges, negatively charged toner having a small amount of charges, and reversely (positively) charged toner. The amount of toner used in developing a toner image on the photosensitive drum 5 increases as the potential difference between the surface of the photosensitive drum 5 and developing roller 22 does so. However, when the potential difference is too small, the weakly charged toner readily adheres to the white background on the photosensitive drum 5, thereby increasing the fog. Whereas when the potential difference is too large, the reversely charged toner readily adheres to the white background on the photosensitive drum 5, thereby increasing the fog as well.

Thus, the potential difference between surface of the photosensitive drum 5 and developing roller 22 is determined to be in a range that minimizes the fog.

(Fourth Experiment)

Next, the relation between the resistance value of the developing roller 22 and the fog was examined, and the result of which is set forth in TABLE 5 below.

The developing roller 22 used herein is made of a silicone rubber material having a hardness of 55° in ASKER C, and renders conductivity by including carbon or the like. The developing roller 22 has a diameter of 16 mm and a peripheral speed of 25 mm/sec. The toner layer thickness regulating member 27 is made of a conductive resin. The toner supplying roller 23 is a hexagonal prism having a diameter of 10 mm and a peripheral speed of 25 mm/sec.

TABLE 5

| RESISTANCE VALUE OF ROLLER 22 [Ω] | $10^3$ | $10^4$ | $10^5$ | $10^6$ | $10^7$ | $10^8$ | $10^9$ | $10^{10}$ |
|---|---|---|---|---|---|---|---|---|
| FOG | 1.0 | 1.0 | 1.0 | 0.5 | 0.5 | 0.5 | 1.8 | 2.0 |

TABLE 5 reveals that the fog is almost negligible when the resistance value of the developing roller 22 is in a range between $10_6$ and $10_8$ [Ω].

The reason why the occurrence of the fog increases when the developing roller 22 has a too small or large resistance value is as follows.

The amount of charges of the toner particle adhering to the developing roller 22 has a correlation with the resistance value of the developing roller 22. To be more specific, when the developing roller 22 has a too small resistance value, the amount of charges of individual toner particles decreases as the charges of the charged toner leak to the developing roller 22. As a result, the weakly charged toner increases in amount and readily adheres to the white background of the photosensitive drum 5, thereby increasing the fog. On the other hand, when the developing roller 22 has a too large resistance value, the reversely charged toner increases in amount and readily adheres to the white background on the photosensitive drum 5, thereby increasing the fog as well.

(Fifth Experiment)

Next, the relation between the polarity of the photosensitive drum 5 and that of the toner as the result of triboelectric charging will be explained. The toner, as has been explained, is charged as the charges are injected into the toner when it passes by the contacting portion of the toner layer thickness regulating member 27 and developing roller 22. Note that, however, the toner is also charged by friction when the photosensitive drum 5 and developing roller 22 press against each other.

Thus, to upgrade the efficiency of triboelectric charging of the toner with the photosensitive drum 5, it is effective to make the photosensitive drum 5 and toner out of materials such that each element is charged to the polarity reversed to each other as the result of triboelectric charging. For example, if a material having a work function of about 4[eV] in triboelectric charging is selected for a primary resin of an OPC (Organic Photoconductor) film of the photosensitive drum 5 and a material having a work function of about 5–5.5[eV] in triboelectric charging is selected as a primary resin of the toner, then the photosensitive drum 5 is positively charged while the toner is negatively charged relative to each other.

Polycarbonate, in particular, is suitable for the primary resin of the OPC film of the photosensitive drum 5. An organic photoconductive and photosensitive material whose primary resin is poly(n-butyl methacrylate), a styrene-butadiene copolymer, an acrylic resin, a polyester resin, or polymethyl methacrylate is also available.

On the other hand, a styrene-acrylic copolymer or polyester resin is suitable for the primary resin of the toner. A non-magnetic monocomponent toner can be made by dispersing a charging controller, such as Cr complex dye, in the primary resin.

Since the toner can be negatively charged evenly if the toner is made of an adequate material, weakly or reversely charged toner can be eliminated, which makes it possible to produce an image with no fog in a stable manner.

(Sixth Experiment)

Next, the state of the fog with respect to a ratio of the peripheral speed of the photosensitive drum 5 to the peripheral speed of the developing roller 22 was examined while the peripheral speed of the photosensitive drum 5 was changed, and the result of which is set forth in TABLE 6 below.

The developing roller 22 used herein is made of a urethane rubber material having a hardness of 50° in ASKER C, and it has a diameter of 30 mm and a peripheral speed of 100 mm/sec. A constant voltage of −400 V was applied to the developing roller 22. The Zener diode 56 used herein can generate a Zener voltage of 100 V. The toner layer thickness regulating member 27 is made of a conductive resin, and was pressed against the developing roller 22 at 1000 gf. The toner supplying roller 23 is a pentagonal prism having a diameter of 10 mm and a peripheral speed of 40mm/sec.

The photosensitive drum 5, made of an organic photoconducter, has a diameter of 30 mm and was charged to have a surface potential of −800 V by the brush-type charger 9 through contact electrification.

TABLE 6

| DRUM 5/ ROLLER 22 | 1.00 | 1.05 | 1.10 | 1.20 | 1.30 | 1.50 | 2.00 | 3.00 |
|---|---|---|---|---|---|---|---|---|
| FOG | 1.5 | 1.0 | 0.7 | 0.5 | 0.5 | 0.5 | 0.5 | 1.0 |

It is understood from TABLE 6 that a satisfactory image with less fog can be produced when the peripheral speed of the developing roller 22 is increased by a factor of 1.1 to 2.0 with respect to the peripheral speed of the photosensitive drum 5.

When the peripheral speed ratio is too low, the photosensitive drum 5, which is pressed against the developing roller 22, can not charge the toner sufficiently by friction, and the unwanted weakly or reversely charged toner remains. On the other hand, when the peripheral speed ratio is too high, the toner fuses onto the bottom surface of the toner layer thickness regulating member 27, which prevents the toner layer thickness regulating member 27 to from forming a toner layer of even thickness on the developing roller 22. Thus, the image quality degrades by defects such as a white streak in a resulting image.

As has been explained, the peripheral speed ratio of the photosensitive drum 5 with respect to the developing roller 22 must be set in an adequate range to produce a satisfactory image.

Note that structures of the developing roller 22, toner supplying roller 23, etc. are not limited to the above disclosure. For example, The developing roller 22 may be made of a carbon-added NBR material having a hardness of 80° in ASKER C, and may have a diameter of 20 mm and a peripheral of 35 mm/sec. Also, the toner layer thickness regulating member 27 made of a photo-conductive resin may be pressed against the above developing roller 22 at 1000 gf. In this case, the toner supplying roller 23 is a pentagonal prism having a diameter of 10 mm and a peripheral speed of 40 mm/sec.

Figure 4:
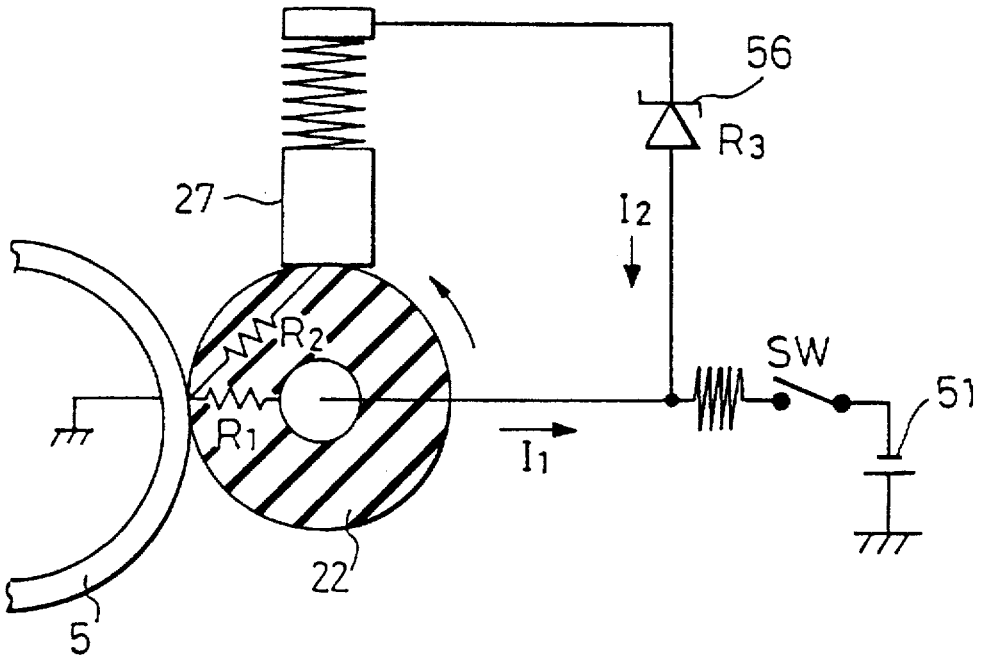
FIG. 4 is a schematic view explaining the operation of a Zener diode in a normal development type developing cartridge.

Referring to FIGS. 4, 5(*b*), and 7, the following description will describe a second embodiment in accordance with the present invention. Hereinafter, like components are labeled with like reference numerals with respect to the first embodiment, and the description of these components is not repeated for convenience.

In the first embodiment, the structure of the developing device of the reversed development type employed in an optical printing device was explained. An example structure of a developing device of a normal development type employed in a copying machine will be explained in the second embodiment.

The developing device of this type is basically of the same structure as the one shown in FIG. 3(*a*) except that the Zener diode 56 is provided in a reversed direction as shown in FIG. 4, the reason why of which will be described below.

In the normal development, a toner image is developed in the following manner. The photosensitive body charged evenly with the negative charges is exposed by light reflected from a white background of an image, and the charges in the exposed portion corresponding to the white background are eliminated. Thus, the positively charged toner adheres to the non-exposed portion corresponding to the black foreground.

Thus, as shown in FIG. 5(*b*), when the printing ratio is low with more white background, most of the photosensitive drum 5 is exposed and an increased amount of charges is lost. Accordingly, the surface potential of the photosensitive drum 5 approximates to the exposing potential of −100 V. On the contrary, when the printing ratio is high with more black foreground, most of the photosensitive drum 5 remains non-exposed and only a small amount of charges is lost. Accordingly, the surface potential of the photosensitive drum 5 approximates to the initial potential of 31 800 V. Therefore, the relation between the surface potential of the photosensitive drum 5 and printing ratio is opposite to the case of the optical printing device employing the developing device of the reversed development type shown in FIG. 5(*a*).

Next, the relation between the printing ratio and a direction of a current running through the Zener diode 56 will be examined. As shown in FIG. 5(*b*), when the developing bias voltage is set to −400 V, the surface potential of the photosensitive drum 5 approximates to the positive side compared with the developing bias voltage in case of developing a low-printing-ratio image. Thus, as shown in FIG. 4, the current $I_2$ flows in a direction from the photosensitive drum 5 to the power source 51 through the toner layer thickness regulating member 27 and Zener diode 56.

The toner is positively charged faster when the Zener diode 56 is designed to operate under the above conditions to maintain the voltage of the toner layer thickness regulating member 27 higher than the potential of the developing roller 22 by the Zener voltage. This is the reason why the anode of the Zener diode 56 is connected to the toner layer thickness regulating member 27 side and the cathode to the power source 51 side in the present embodiment.

When a detachable/attachable developing cartridge of the normal development type is provided in a copying machine, the developing cartridge uses only one terminal to supply two voltages having their respective potentials to the developing roller 22 and toner layer thickness regulating member 27, only if the connection of the Zener diode 56 is reversed with respect to the case of the optical printing device employing the developing device of the reversed development type.

Figure 11:
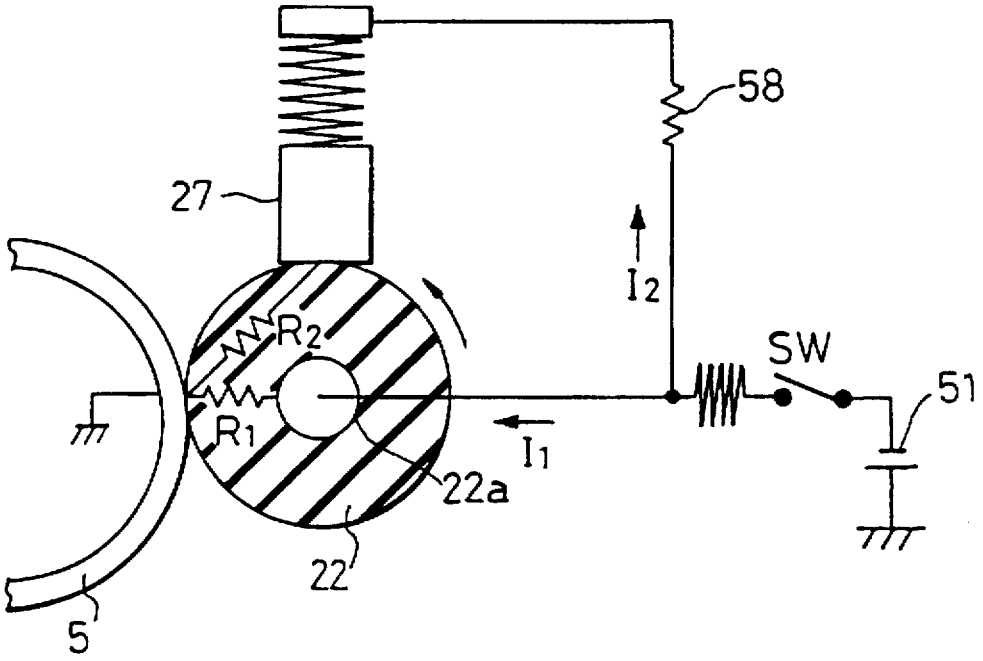
FIG. 11 is a schematic view explaining an operation of a resistor in the reversal development type developing cartridge in accordance with the present invention.

Note that the above embodiment described the structure where the Zener diode 56 was provided to make a constant potential difference between the developing roller 22 and toner layer thickness regulating member 27 in case of producing a low-printing-ratio image; however, the Zener diode 56 may be replaced with a resistor 58 as shown in FIG. 11. Further, the resistor 58 may be replaced with a varistor.

Figure 7A:
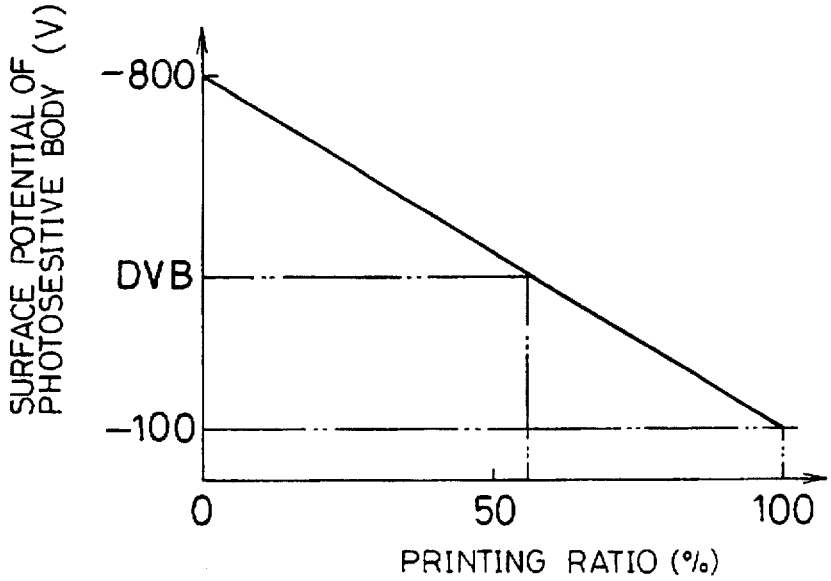
FIGS. 7(*a*) through 7(*c*) are graphs explaining the relation between a printing ratio and a voltage generated across a resistor connected to a toner layer thickness regulating member.
Figure 7B:
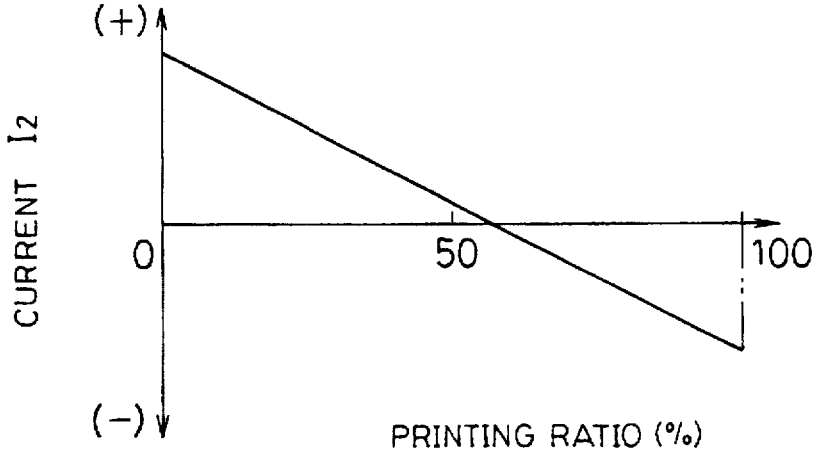
Figure 7C:
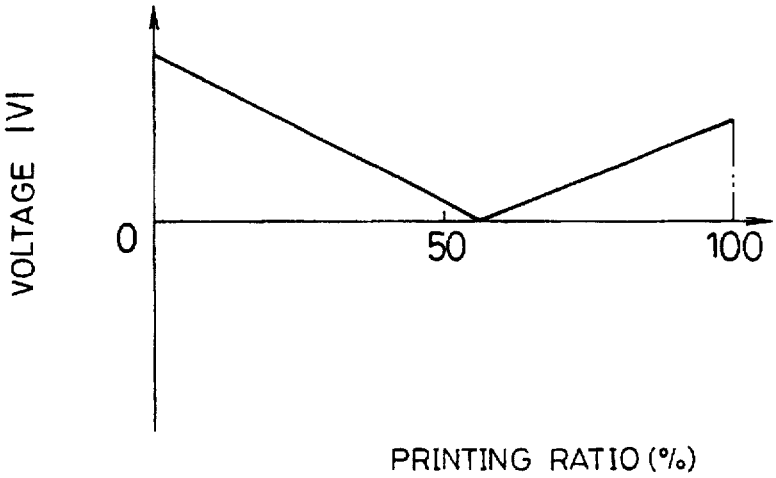
Figure 8:
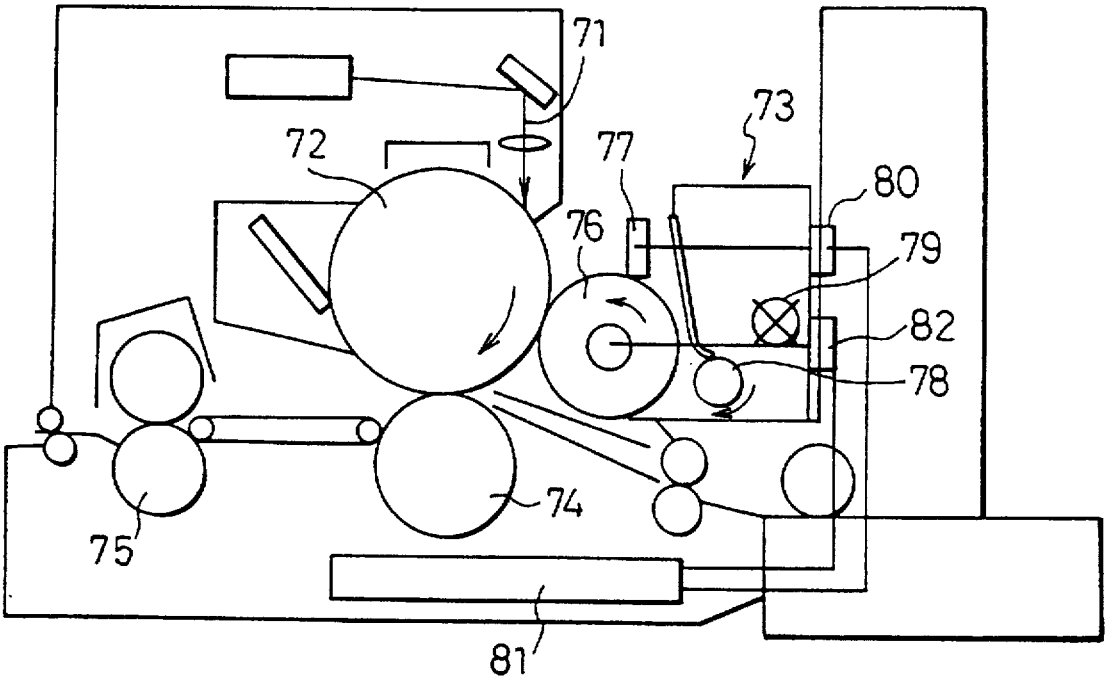
FIG. 8 PRIOR ART
FIG. 8 is a view showing the entire structure of a conventional optical printing device.
Figure 9:
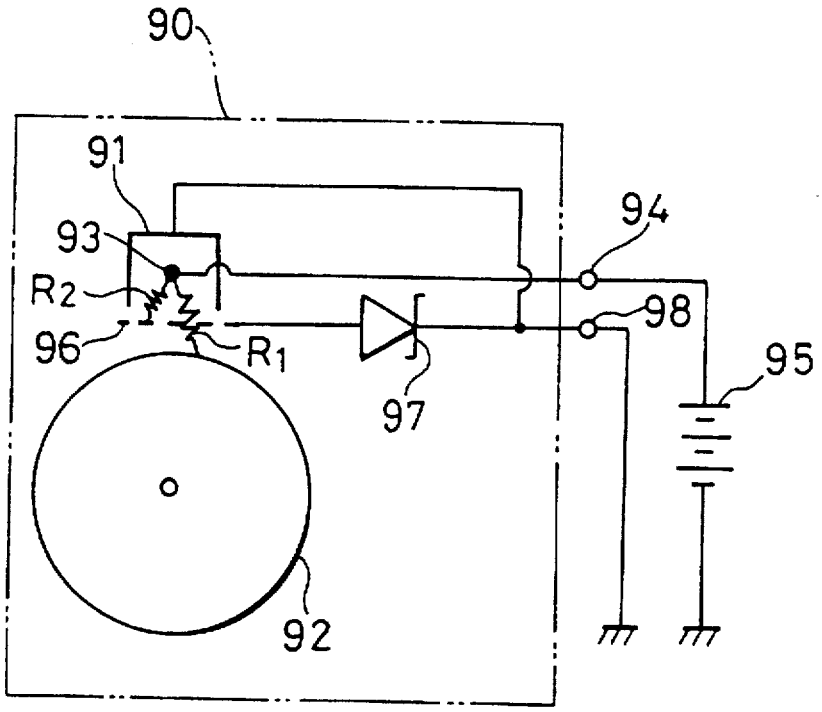
FIG. 9 PRIOR ART
FIG. 9 is a view schematically explaining a major part of a conventional electrophotographic apparatus.

As previously explained, in case of the optical printing device of the reversed development type, if the surface potential of the photosensitive drum 5 changes as shown in FIG. 7(*a*), the current $I_2$ running through the resistor 58 replacing the Zener diode 56 changes as shown in FIG. 7(*b*). In other words, in case of producing a low-printing-ratio image where the surface potential of the photosensitive drum 5 is greater in the negative side than the developing bias voltage (DBV), the current $I_2$ flows in a direction from the toner layer thickness regulating member 27 to the power source 51. The current $I_2$ decreases gradually as the printing ratio increases.

When the surface potential of the photosensitive drum 5 becomes equal to the developing bias voltage (DBV), the current $I_2$ drops to nil. Then, in case of producing a high-printing-ratio image where the surface potential of the photosensitive drum 5 is greater in the positive side compared with the developing bias voltage (DBV), the current $I_2$ flows in a reversed direction, that is, from the power source 51 to the toner layer thickness regulating member 27. The current $I_2$ gradually increases as the printing ratio increases.

Therefore, the absolute value of the voltage across the resistor 58 varies in accordance with the current $I_2$ as shown in FIG. 7(*c*). Thus, the resistor 58 replacing the Zener diode 56 generates a higher voltage as the printing ratio decreases, and reduces the voltage of the toner layer thickness regulating member 27 than the developing bias voltage in a better manner. Accordingly, the resistor 58 can reduce the weakly or reversely charged toner in case of a low-printing-ratio image with which the fog readily appears on the white background.

Also, in case of the varistor replacing the Zener diode 56, the variance in voltage in response to the variance in current is small compared with the resistor 58, and the varistor can realize a similar effect to the one realized by the Zener diode 56.

The invention thus being described, it will be obvious that the same may be varied in many ways. Such variations are not to be regarded as a departure from the spirit and scope of the invention, and all such modification as would be obvious to one skilled in the art are intended to be included within the scope of the following claims.

What is claimed is:

1. A developing device, employed in an image forming apparatus, for developing a static latent image formed on a photosensitive body, the developing device comprising:

a developer carrying body for holding a developer layer on a surface thereof and for transporting a developer by physical contact with said photosensitive body, a first voltage which is constant being supplied to said developer carrying body from a power source of an image forming apparatus main body;

a conductive developer layer thickness regulating member, connected to said power source, for regulating said developer layer to a constant thickness by physical contact with said developer carrying body; and a constant voltage element, provided in a path connecting said power source and said conductive developer layer thickness regulating member, for applying a second voltage which is constant to said conductive developer layer thickness regulating member, said constant voltage element generating a third voltage which is constant using a current generated in response to a balance between a surface potential of said photosensitive body and a potential of said power source, said second voltage being different from said first voltage.

2. The developing device as defined in claim 1, wherein said constant voltage element is a Zener diode.

3. The developing device as defined in claim 1, wherein the third voltage generated by said constant voltage element has an upper limit to keep a potential of a surface of said developer layer on said developer carrying body lower than a surface potential which said photosensitive body had when a developing process started.

4. The developing device as defined in claim 1, wherein a transporting speed of said developer carrying body is not high enough to fuse the developer onto said conductive developer layer thickness regulating member, but is greater higher than a speed at which a surface of said photosensitive body moves when developing the static latent image.

5. The developing device as defined in claim 1, wherein an absolute value of the surface potential of said photosensitive body is set greater than an absolute value of a potential of said developer carrying body by 100V–500V.

6. The developing device as defined in claim 1, wherein said photosensitive body is charged to a polarity reversed with respect to a polarity of said developer as a result of triboelectric charging.

7. The developing device as defined in claim 1, wherein said developer is a non-magnetic monocomponent developer.

8. The developing device as defined in claim 1, wherein the developing device is a reversal development type device for attracting a negatively charged developer to an exposed portion of a surface of said photosensitive body, said constant voltage element generating the third voltage using a current flowing from the surface of said photosensitive body to said power source.

9. The developing device as defined in claim 1, wherein the developing device is a normal development type device for attracting positively charged developer to a non-exposed portion of a surface of said photosensitive body, said constant voltage element generating the third voltage using a current flowing from the surface of said photosensitive body to said power source.

10. The developing device as defined in claim 1, wherein said constant voltage element generates a voltage ranging from 10V to 500V.

11. The developing device as defined in claim 7, wherein a primary resin of said non-magnetic monocomponent developer is one of a styrene-acrylic copolymer and a polyester resin.

12. The developing device as defined in claim 1, wherein said developer carrying body is a developing roller, a peripheral speed of said developing roller being increased by a factor of 1.1 to 2.0 with respect to a speed at which a surface of said photosensitive body moves when developing the static latent image.

13. The developing device as defined in claim 1, wherein said developer carrying body is made of a conductive, resilient rubber material.

14. The developing device as defined in claim 13, wherein said developer carrying body has a resistance value in a range between $10^6\Omega$ and $10^8\Omega$.

15. The developing device as defined in claim 13, wherein said developer carrying body has a hardness in a range between 50° and 90° in ASKER C.

16. The developing device as defined in claim 1, wherein said conductive developer layer thickness regulating member is made of one of aluminium or iron.

17. The developing device as defined in claim 1, wherein said conductive developer layer thickness regulating member is made of a conductive resin.

18. The developing device as defined in claim 1, further comprising a spring for pressing said conductive developer layer thickness regulating member against said developer carrying body at a predetermined pressure.

19. The developing device as defined in claim 18, wherein said predetermined pressure is in a range between 500 gf and 2000 gf.

20. The developing device as defined in claim 1, wherein said path connecting said power source and said conductive developer layer thickness regulating member is a voltage applying line for said conductive developer layer thickness regulating member, said voltage applying line being embedded in a frame of the developing device.

21. The developing device as defined in claim 1, wherein said photosensitive body includes an organic photoconductive film having a primary resin which is polycarbonate.

22. The developing device as defined in claim 1, wherein said photosensitive body is a cylindrical photosensitive drum.

23. The developing device as defined in claim 1, further comprising a developer supplying member for transporting and supplying the developer to said developer carrying body.

24. The developing device as defined in claim 23, wherein said developer supplying member is a developer supplying roller, said developer supplying roller being provided around said developer carrying body to rotate without having any physical contact with said developer carrying body.

25. The developing device as defined in claim 24, wherein said developer supplying roller is a regular polyprism, a polygonal face of said regular polyprism having five to eight sides.

26. The developing device as defined in claim 23 further including a developer stirring roller for stirring the developer to transport the developer to said developer supplying member.

27. The developing device as defined in claim 24, wherein said developer carrying body is a developing roller, a rotational axis of said developing roller and a rotational axis of said developer supplying roller being parallel to each other.

28. The developing device as defined in claim 27, further comprising a developer applying member, provided around a side surface of said developing roller, for pressing the developer transported from said developer supplying roller against said developing roller, said developer applying member having a circular arc convex surface opposing said side surface, said developer applying member having an end portion touching a side surface of said developer supplying roller for scraping off the developer adhering to said developer supplying roller.

29. The developing device as defined in claim 28, further comprising a developer stirring roller for stirring the developer to transport the developer to said developer supplying roller, wherein said developing applying member is provided with a through hole, extra developer scraped off by said conductive developer layer thickness regulating member being returned to said developer stirring roller through said through hole.

30. A developing device, employed in an image forming apparatus, for developing a static latent image formed on a photosensitive body, the developing device comprising:

a developer carrying body for holding a developer layer on a surface thereof and for transporting a developer by physical contact with said photosensitive body, a first voltage which is constant being supplied to said developer carrying body from a power source of an image forming apparatus main body;

a conductive developer layer thickness regulating member, connected to said power source, for regulating said developer layer to a constant thickness by physical contact with said developer carrying body; and a potential difference generating element, provided in a path connecting said power source and said conductive developer layer thickness regulating member, for applying a second voltage which is constant to said conductive developer layer thickness regulating member by generating a potential difference between said power source and said conductive developer layer thickness regulating member using a current generated in response to a difference between a surface potential of said photosensitive body and a potential of said power source, said second voltage being different from said first voltage.

31. The developing device as defined in claim 30, wherein said potential difference generating element is a resistor.

32. The developing device as defined in claim 30, wherein said potential difference generating element is a varistor.

33. A developing device, employed in an image forming apparatus, for developing a static latent image formed on a photosensitive body, the developing device comprising:

a developer carrying body for holding a developer layer on a surface thereof and for transporting a developer by physical contact with said photosensitive body, a first voltage which is constant being supplied to said developer carrying body from a power source of an image forming apparatus main body;

a conductive developer layer thickness regulating member, connected to said power source, for regulating said developer layer to a constant thickness by physical contact with said developer carrying body; and a constant voltage element, provided in a path connecting said power source and said conductive developer layer thickness regulating member, for applying a second voltage which is constant to said conductive developer layer thickness regulating member, said constant voltage element generating a third voltage which is constant using a current running between said power source and said conductive developer layer thickness regulating member, said second voltage being different from said first voltage, the developing device being attachable to and detachable from said image forming apparatus main body, the developing device being electrically connected to said power source of said image forming apparatus main body through a single junction terminal when attached to said image forming apparatus main body, said single junction terminal being composed of one terminal portion formed in a frame of the developing device and another terminal portion formed on said image forming apparatus main body, said one terminal portion and said another terminal portion being separable.

34. A method of developing a static latent image on a photosensitive body of a developing device in an image forming apparatus comprising the steps of:

applying a developer layer on a surface of a developer carrying body;

applying a first voltage which is constant from a power source of the image forming apparatus to the developer carrying body;

regulating a thickness of the developer layer on the surface of the developer carrying body with a regulating member;

applying a second voltage which is constant to the regulating member, the second voltage being provided by a constant voltage element provided in a path between the regulating member and the power source, the constant voltage element generating a third voltage which is constant using a current generated in response to a balance between a surface potential of the photosensitive body and a potential of the power source, the second voltage being different than the first voltage; and contacting the developer carrying body with the photosensitive body to transport the developer from the developer carrying body to the photosensitive body.

35. A method of developing a static latent image on a photosensitive body of a developing device in an image forming apparatus comprising the steps of:

applying a developer layer on a surface of a developer carrying body;

applying a first voltage which is constant from a power source of the image forming apparatus to the developer carrying body;

regulating a thickness of the developer layer on the surface of the developer carrying body with a regulating member;

applying a second voltage which is constant to the regulating member, the second voltage being provided by a potential difference generating element provided in a path between the regulating member and the power source, the potential difference generating element generating a potential difference between the power source and the regulating member using a current generated in response to a difference between a surface potential of the photosensitive body and a potential of the power source, the second voltage being different than the first voltage; and contacting the developer carrying body with the photosensitive body to transport the developer from the developer carrying body to the photosensitive body.

* * * * *